US008479651B2

(12) United States Patent
Schaeffer et al.

(10) Patent No.: US 8,479,651 B2
(45) Date of Patent: Jul. 9, 2013

(54) PYROTECHNIC TRAINING SYSTEM

(75) Inventors: Diana P. Schaeffer, Denville, NJ (US); James Leung Mok, San Diego, CA (US)

(73) Assignee: Pacific Coast Systems, Asbury, NJ (US)

( * ) Notice: Subject to any disclaimer, the term of this patent is extended or adjusted under 35 U.S.C. 154(b) by 0 days.

(21) Appl. No.: 13/315,733

(22) Filed: Dec. 9, 2011

(65) Prior Publication Data

US 2012/0180679 A1 Jul. 19, 2012

Related U.S. Application Data

(60) Provisional application No. 61/431,599, filed on Jan. 11, 2011.

(51) Int. Cl.
*F42C 19/12* (2006.01)
*F41A 33/04* (2006.01)

(52) U.S. Cl.
USPC ..... 102/206; 102/293; 102/200; 102/262; 434/11

(58) Field of Classification Search
USPC ..... 102/335, 355, 356, 424, 428, 429, 102/498, 200, 206, 221, 222, 254, 256, 262, 102/263; 434/11, 16
See application file for complete search history.

(56) References Cited

U.S. PATENT DOCUMENTS

| | | | |
|---|---|---|---|
| 1,370,193 | A | 3/1921 | Crocker |
| 2,108,818 | A | 2/1938 | Huff et al. |
| 2,396,699 | A | 3/1946 | Hayes et al. |
| 2,421,491 | A | 6/1947 | Gearon et al. |
| 2,526,670 | A | 10/1950 | Kissinger et al. |
| 2,717,533 | A | 9/1955 | Wells |
| 2,962,965 | A | 12/1960 | Farnsworth et al. |
| 3,054,870 | A | 9/1962 | Wagoner |
| 3,336,870 | A | 8/1967 | Gunyan et al. |
| 3,535,809 | A | 10/1970 | Hoffman |
| 3,721,190 | A | 3/1973 | Lewis et al. |
| 3,722,418 | A | 3/1973 | Hoffman |

(Continued)

FOREIGN PATENT DOCUMENTS

| | | | |
|---|---|---|---|
| DE | 3506412 | A1 | 6/1989 |
| DE | 19617060 | C2 | 11/1997 |

(Continued)

OTHER PUBLICATIONS

Design U.S. Appl. No. 29/383,033 for Casing for a Pyrotechnic Training Unit, filed Jan. 11, 2011—Application and Figures as filed.

(Continued)

*Primary Examiner* — James Bergin
(74) *Attorney, Agent, or Firm* — Greenberg Traurig, LLP

(57) ABSTRACT

A pyrotechnic training system includes a firing block assembly housed in a first container, a pressure-armed trigger module having two triggers housed in a second container, and a power pack/switch system that connects the firing block assembly and triggers. The first and second containers are remote from each other, and may be made from common objects that might be found in combat zones. Quick-release pins inserted through components of the firing block prevents their separation by exploding ordinance within the firing block, maintaining close electrical contacts within the firing block. The pressure-armed triggers employ a mechanical system that energizes an electrical circuit when pressure is released. Such triggers are arranged such that opening or moving the container triggers an explosion at the remote firing block assembly.

5 Claims, 15 Drawing Sheets

U.S. PATENT DOCUMENTS

| | | | | |
|---|---|---|---|---|
| 3,752,082 | A | | 8/1973 | Kernan |
| 3,808,940 | A | | 5/1974 | Schillreff et al. |
| 4,014,262 | A | | 3/1977 | Betts |
| 4,217,717 | A | | 8/1980 | Canty et al. |
| 4,245,403 | A | | 1/1981 | Hipp |
| 4,307,665 | A | | 12/1981 | Block et al. |
| 4,325,304 | A | | 4/1982 | Ormiston |
| 4,342,556 | A | | 8/1982 | Hasse |
| 4,389,947 | A | | 6/1983 | King et al. |
| 4,438,700 | A | | 3/1984 | Knapp |
| 5,074,793 | A | | 12/1991 | Hambric et al. |
| 5,117,731 | A | | 6/1992 | Mendenhall |
| 5,157,222 | A | | 10/1992 | La Mura et al. |
| 5,207,579 | A | | 5/1993 | Campagnuolo |
| 5,216,965 | A | | 6/1993 | Liptak et al. |
| 5,235,127 | A | | 8/1993 | Findley |
| 5,282,455 | A | | 2/1994 | Adamson et al. |
| 5,381,721 | A | | 1/1995 | Holmstrom et al. |
| 5,450,686 | A | | 9/1995 | La Mura et al. |
| 5,460,096 | A | | 10/1995 | Kothe |
| 5,474,452 | A | * | 12/1995 | Campagnuolo ..... 434/11 |
| 5,554,817 | A | | 9/1996 | La Mura et al. |
| 5,559,303 | A | | 9/1996 | La Mura et al. |
| 5,563,366 | A | | 10/1996 | La Mura et al. |
| 5,585,595 | A | | 12/1996 | Dix |
| 5,688,124 | A | | 11/1997 | Salzeder |
| 5,719,501 | A | | 2/1998 | Spektor et al. |
| 5,739,459 | A | | 4/1998 | La Mura et al. |
| 5,739,462 | A | | 4/1998 | Poor et al. |
| 5,767,437 | A | | 6/1998 | Rogers |
| 5,801,322 | A | | 9/1998 | Laine et al. |
| 5,824,945 | A | | 10/1998 | Barlog et al. |
| 5,877,448 | A | | 3/1999 | Denton et al. |
| 5,944,502 | A | | 8/1999 | Denchfield |
| 6,101,950 | A | | 8/2000 | Kothe |
| 6,205,927 | B1 | | 3/2001 | Findley |
| 6,237,273 | B1 | | 5/2001 | La Mura et al. |
| 6,318,350 | B1 | | 11/2001 | Williams |
| 6,393,990 | B1 | | 5/2002 | Fagan |
| 6,431,070 | B1 | | 8/2002 | La Mura |
| 6,502,343 | B2 | | 1/2003 | Cheng |
| 6,505,558 | B1 | | 1/2003 | La Mura et al. |
| 6,553,912 | B2 | | 4/2003 | Wygant |
| 6,599,127 | B1 | | 7/2003 | Hopmeier et al. |
| 6,845,715 | B2 | | 1/2005 | Sansolo |
| 7,066,320 | B2 | | 6/2006 | Sansolo |
| 7,083,414 | B2 | | 8/2006 | Sansolo |
| 7,314,005 | B2 | | 1/2008 | Deye |
| 7,387,073 | B2 | | 6/2008 | Bodley et al. |
| 7,507,089 | B2 | | 3/2009 | Jones et al. |
| 7,568,431 | B1 | | 8/2009 | Stria |
| 7,597,047 | B2 | | 10/2009 | Doyle et al. |
| 7,922,491 | B2 | | 4/2011 | Jones et al. |
| 8,011,928 | B1 | | 9/2011 | Schaeffer |
| 2002/0144620 | A1 | | 10/2002 | Scherer et al. |
| 2006/0123684 | A1 | | 6/2006 | Bunney |
| 2006/0162602 | A1 | | 7/2006 | Garms et al. |
| 2007/0015115 | A1 | | 1/2007 | Jones et al. |
| 2007/0166667 | A1 | | 7/2007 | Jones et al. |
| 2007/0199469 | A1 | | 8/2007 | Zahn |
| 2008/0000377 | A1 | | 1/2008 | Doyle et al. |
| 2008/0280264 | A1 | | 11/2008 | Segal |
| 2009/0246740 | A1 | | 10/2009 | Jones et al. |
| 2009/0263765 | A1 | | 10/2009 | Jones et al. |
| 2011/0048271 | A1 | | 3/2011 | Colon |
| 2012/0180679 | A1 | * | 7/2012 | Schaeffer et al. ..... 102/206 |

FOREIGN PATENT DOCUMENTS

| | | | | |
|---|---|---|---|---|
| DE | 19617061 | C2 | | 11/1997 |
| WO | WO 9415168 | A1 | * | 7/1994 |
| WO | WO 2008/097324 | | | 8/2008 |

OTHER PUBLICATIONS

Oct. 9, 2008 Office Action received in U.S. Appl. No. 11/427,855 for Simulating an Explosion of an Improvised Explosive Device, filed Jun. 30, 2006.

PCT Notification of Transmittal of the ISR and the WO of the international Searching Authority in PCT/US2007/071063, dated Oct. 7, 2008.

Erwin, Sandra I., "Mock 'IEDs' Help Soldiers Prepare for War", National Defense Magazine, http://www.nationaldefensemagazine.org/issues/2005/dec1/UF-Mock.htm, 3 pgs.

"Solution: UNITECH", Training Improvised Explosive Device (TIED), www.UNITECH1.com, 1 page.

"Solution: Unitech", Simulation Projects: http://www.unitech1.com/solutions_sim_p2.htm, 5 pgs.

Apr. 15, 2005 Office Action received in U.S. Appl. No. 10/713,127 for Multi-Purpose Pyrotechnic Trainer, filed Nov. 14, 2003.

Jul. 25, 2006 Office Action received in U.S. Appl. No. 10/713,127 for Multi-Purpose Pyrotechnic Trainer, filed Nov. 14, 2003.

Apr. 16, 2008 Office Action received in U.S. Appl. No. 10/713,127 for Multi-Purpose Pyrotechnic Trainer, filed Nov. 14, 2003.

Jan. 6, 2009 IPRP received in PCT Patent Application No. PCT/US2007/071063 for Simulating an Explosion of an Improvised Explosive Device, filed Jun. 13, 2007.

* cited by examiner

PYROTECHNIC TRAINING SYSTEM

CROSS-REFERENCE TO RELATED APPLICATIONS

The present application claims the benefit of U.S. Provisional Patent Application Ser. No. 61/431,599, filed on Jan. 11, 2011, the disclosure of which is incorporated herein by reference in its entirety.

FIELD OF THE INVENTION

The present invention is directed towards pyrotechnic training units, and is more specifically directed towards pyrotechnic improvised explosive device (IED) simulators and external triggering devices for same.

BACKGROUND OF THE INVENTION

Enemy combatants often use explosive devices such as improvised explosive devices (IEDs) to cause damage, injury, and death. IEDs remain a leading killer of Allied forces. Insurgents search for discarded weapon materials amid the abundant rubble to make homemade explosives (HMEs). For example, a common technique involves packing expended artillery rounds with new explosives and emplacing them as road-side or buried IEDs. Protection of vehicles and personnel against such threats is an important issue in the area of defense research. Accordingly, personnel are trained to deal with homemade explosives. During training, military and law enforcement personnel use IED simulators that help personnel identify homemade explosives and react to their effects in real-time simulations. Simulators should replicate the explosive effect of an improvised road-side bomb. The simulators of the present invention can simulate the audio and visual impacts of explosions of an IED in a live training scenario without the likelihood of injury.

SUMMARY OF THE INVENTION

An apparatus for simulating an explosive device, in one exemplary embodiment, includes at least one firing block having a top portion including at least one receptacle designed to receive one or more types of pyrotechnic cartridges, a bottom portion embedded with at least one contact assembly in substantial alignment with a corresponding receptacle, and an electronic housing; and a base designed to support each of the firing blocks, wherein each of the firing blocks is equipped with quick release pins, which, when connected to additional components of the firing block, are designed to impart durability and sustainability over time to the firing block. The quick release pins and additional components of the firing block help to maintain intimate contact between the top portion and the bottom portion that is required to allow for passage of electricity between an electrical contact on each of the pyrotechnic cartridges and respective contact assembly on the bottom portion, which in turn completes a circuit indicating that the apparatus is properly latched and allowing circuitry to continue with an arming procedure. In an embodiment, an apparatus of the present invention can be housed in an artillery shell casing with or without a blast cavity. In an embodiment, an apparatus of the present invention can be housed in common lidded containers with or without a blast cavity. In an embodiment, an apparatus of the present invention can be housed in a metal can with a blast cavity. In an embodiment, an apparatus of the present invention can be housed in a jug with a blast cavity. In an embodiment, an apparatus of the present invention can be housed in a replica of an animal carcass with or without a blast cavity. In an embodiment, an apparatus of the present invention can be housed in a pressure cooker without a blast cavity.

In an embodiment, each of the firing blocks releasably engages the base. In an embodiment, the electronic housing releasably engages the base, either directly or indirectly via a single platform or multiple platforms. In an embodiment, each of the firing blocks is operable to simulate one or more distinct signatures of an explosive device. In an embodiment, each of the receptacles is adapted to receive at least two different types of pyrotechnic rounds, such as a US Army type classified round or a non-type classified round. In such embodiments, each of the receptacles includes a first boring having a first diameter, a second boring having a second diameter, which is greater than the first diameter, and a third boring positioned between the first boring and the second boring, the third boring having a third diameter, which is greater than the first diameter but less than the second diameter. In an embodiment, each of the firing blocks includes at least one receptacle having a constant diameter. In an embodiment, each of the firing blocks includes two or more receptacles each having a constant diameter that is equal to each other. In an embodiment, each of the firing blocks includes two or more receptacles each having a constant diameter that is different from one another.

In an embodiment, the apparatus also includes a power pack operable to provide power to, and to control the operation of, each of the firing blocks. The power pack provides power to control the operation of each of the firing blocks and has multi-triggering, user-controlled capabilities chosen from one of: radio-controlled (RC) detonation; victim-operated (VO) detonation; command/hard wired (CW) detonation; disable power/jamming functions; or combinations thereof.

In an embodiment, the apparatus further includes at least one decoy external triggering device in operable communication with the power pack by way of a plug and play cable connection, the decoy triggering device being actuated by a user to trigger detonation of the selected rounds. In an embodiment, the base of the firing block includes a handle and multiple ports for power connection and daisy-chain capability with the power pack. In an embodiment, the firing block/base assembly is housed in an artillery shell casing with a blast cavity. In an embodiment, the firing block/base assembly is housed in a pressure cooker without a blast cavity.

BRIEF DESCRIPTION OF THE DRAWINGS

The presently disclosed embodiments will be further explained with reference to the attached drawings, wherein like structures are referred to by like numerals throughout the several views. The drawings shown are not necessarily to scale, with emphasis instead generally being placed upon illustrating the principles of the presently disclosed embodiments.

Figure 1:
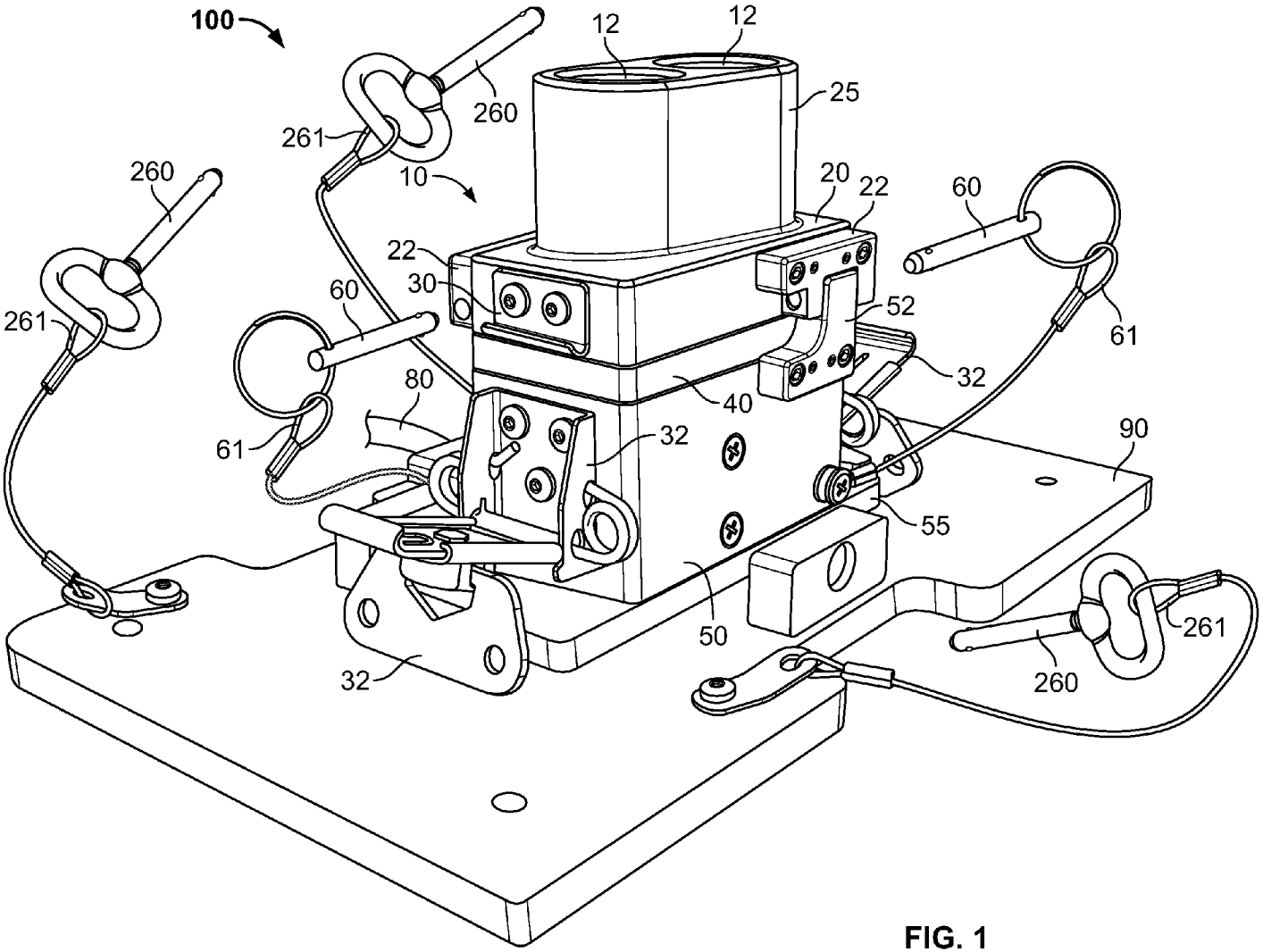
FIG. 1 is a partially exploded perspective view of an illustrative embodiment of a firing block/base assembly adapted for use in a pyrotechnic IED simulator of the present invention.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION OF THE INVENTION

The present invention relates to pyrotechnic training units, and is more specifically directed towards pyrotechnic improvised explosive device (IED) simulators that replicate the explosive effect of an improvised road-side bomb. The simulators of the present invention can simulate homemade explosives (HMEs), which is a form of an improvised explosive device (IED), and provides realistic, yet safe, audio and visual simulations of explosions. The simulators of the present invention feature at least one firing block designed for durability and sustainability over time.

In an embodiment, a pyrotechnic IED simulator of the present invention includes at least one firing block releasably engaging a base. Each of the firing blocks includes a top portion, a bottom portion and an electronic housing. The electronic housing releasably engages the base, either directly or indirectly via a single platform or multiple platforms. Each of the firing blocks is equipped with quick release pins, which, when connected to additional components of the firing block, are designed to impart durability and sustainability over time to the firing block. Each of the firing blocks is operable to simulate one or more distinct signatures of an explosive device. The quick release pins and additional components of the firing block help to maintain the intimate contact between the top portion and the bottom portion that is required to allow for the passage of electricity between the electrical contacts on the pyrotechnic cartridges and respective contact assemblies on the bottom portion, which in turn completes a circuit indicating that the pyrotechnic IED simulator is properly latched and allowing the circuitry to continue with an arming procedure.

In an embodiment, each firing block includes one receptacle capable of receiving at least one of a US Army type classified round or a non-type classified round. In an embodiment, each firing block includes two receptacles, each receptacle capable of receiving at least one type of a US Army type classified round or a non-type classified round. In such embodiments, each receptacle may have a constant diameter that is equal to or different from each other. In an embodiment, each firing block includes two receptacles, each receptacle being capable of receiving at least two different types of a US Army type classified round or a non-type classified round. In such embodiments, each of the receptacles may include a first boring having a first diameter, a second boring having a second diameter, which is greater than the first diameter, and a third boring positioned between the first boring and the second boring, the third boring having a third diameter, which is greater than the first diameter but less than the second diameter. In an embodiment, the pyrotechnic IED simulator also includes a power pack operable to provide power to, and to control the operation of, each of the firing blocks. The power pack provides power to control the operation of each firing block and has multi-triggering user-controlled capabilities chosen from one of: radio-controlled (RC) detonation; victim-operated (VO) detonation; command/hard wired (CW) detonation; disable power/jamming functions; or combinations thereof. In an embodiment, the pyrotechnic IED simulator further includes at least one external triggering device in operable communication with the power pack by way of a plug and play cable connection, the triggering device being controllable by a user to trigger detonation of the selected round(s). In an embodiment, the base includes a handle and multiple ports for power connection and daisy-chain capability. In an embodiment, the pyrotechnic IED simulator is housed in an artillery shell casing with a blast cavity. In an embodiment, the pyrotechnic IED simulator is housed in a pressure cooker without a blast cavity.

FIG. 1 is a partially exploded perspective view of an illustrative embodiment of a firing block/base assembly 100 adapted for use in a pyrotechnic IED simulator of the present invention. The assembly 100 includes a firing block 10 releasably engaging a base 90. The firing block 10 represents a device operable to simulate one or more distinct signatures, for example, the visual, audio, or both visual and audio signatures, of an explosive device. The nature of a blast can create at least one of a realistic audio (loud bang), visual (smoke puff) or flash signature of an explosion. In an embodiment, the assembly 100 produces a large explosive effect, offering effective, realistic survivability training for combat situations. In an embodiment, the assembly 100 produces realistic visual, audible and concussive effects of an IED in a safe manner. In an embodiment, the base 90 is a 100% heavy-gauge aluminum base that stabilizes the concussive effect of a two-round blast. It should be understood that the substantially rectangular-shaped base 90 can be designed in a wide variety of sizes, shapes, and materials. A cable 80, which is attaches to ports 85 on the firing block 10 (see FIG. 2A), attaches to ports on a power pack (not shown) thus establishing a pathway for communicating a detonation command to the firing block 10.

The firing block 10 can receive an explosive device, such as a pyrotechnic cartridge or material. The firing block 10 includes a top portion 20, a bottom portion 40 and an electronic housing 50. The electronic housing 50 releasably engages the base 90, either directly or indirectly via a single platform or multiple platforms 55. Latch keepers 30 cooperate with latch-to-latch assemblies 32 to connect the top portion 20 to the bottom portion 40 and electronic housing 50. The bottom portion 40 may include electrical contacts (not visible) capable of transmitting a detonation signal. Such electrical contacts are discussed more fully with respect to FIG. 4. In the embodiment illustrated, the latch keepers 30/latch assemblies 32 are provided on each of the shorter widths of the top portion 20 and the electronic housing 50, at opposite ends of the firing block 10. In other embodiments, the latch keepers 30/latch assemblies 32 may be provided on the longer widths of the firing block 10, or a latch keeper 30/latch assembly 32 may be provided on one end and hinges (not shown) provided on the other end. In a hinged embodiment, the hinges may secure the top portion 20 and bottom portion 40 to each other such that they can swing away from the electronic housing 50 as a single element. As illustrated in FIG. 1, the top portion 20 includes a magazine 25 having two receptacles 12. It should be understood that the magazine 25 can include any number of receptacles 12, such as one receptacle, two receptacles, three receptacles or more. Each of the receptacles 12 can receive one or more pyrotechnic cartridges (not visible) that can direct a pyrotechnic explosion in a predetermined direction. The pyrotechnic cartridge includes pyrotechnic material which comprises a chemical mixture that can be used to generate an exothermic reaction by combustion, deflagration, or detonation to produce visual and audio effects. The material may include an oxidizing agent (oxidant) and a fuel that produces the exothermic reaction when heated to its ignition temperature. The pyrotechnic cartridge may have electrical contacts (for example, a center contact pin/electrode and an outer contact pin electrode) operable to receive a detonation signal to heat the fuel. Any suitable pyrotechnic cartridge that displays at least one of an audio or visual (e.g., flash bang effect) signature and/or a star cluster effect may be used, for example, a type classified US Army approved ammunition/pyrotechnic (e.g., M30 rounds or M31 black or yellow smoke). Any suitable pyrotechnic cartridge that realistically and safely simulates the smoke, bang and flash signatures of various weapons can be used. In an embodiment, each receptacle is adapted to receive at least one of a US Army type classified round or a non-type classified round.

In an embodiment, the magazine 25 includes one receptacle 12 having a constant diameter. In an embodiment, the magazine 25 includes one receptacle 12 having a varying diameter. In an embodiment, the magazine 25 includes two or more receptacles 12 each having a constant diameter that is the same as each other receptacle 12. In an embodiment, the magazine 25 includes two or more receptacles 12 each having a constant diameter that is different from another receptacle 12. In an embodiment, each of the receptacles 12 includes a first boring having a first diameter, a second boring having a second diameter, which is greater than the first diameter, and a third boring positioned between the first boring and the second boring, the third boring having a third diameter, which is greater than the first diameter but less than the second diameter. The first, second and third diameters can be selected such that each of the receptacles can selectively and interchangeably receive at least two different types of rounds, such as an M30 and an M31 round. In an embodiment, each of the receptacles 12 can hold a US Army type classified M30 round. The US Army type classified M30 rounds can realistically yet safely simulate the smoke puff (visual) and bang (audio) signatures of an IED, without producing a starburst (flash) signature, such as those found in a US Army type classified M31 rounds. In an embodiment, each of the receptacles 12 can hold a US Army type classified M31 black or yellow smoke round. In an embodiment, the receptacles 12 can hold one US Army type classified M30 round, and one US Army type classified M31 black or yellow smoke round. In an embodiment, each of the receptacles 12 has a single boring of a single diameter for accepting only one type of US Army type classified round, such as a US Army type classified M30 round. In some embodiments, it may be desirable to use a US Army type classified round that includes a flash starburst-signature, as long as the area near the blast is considered nonflammable, i.e., there are no trees, brush, fuel, or any other material or object that is considered ignitable.

Figures 2A, 2B:
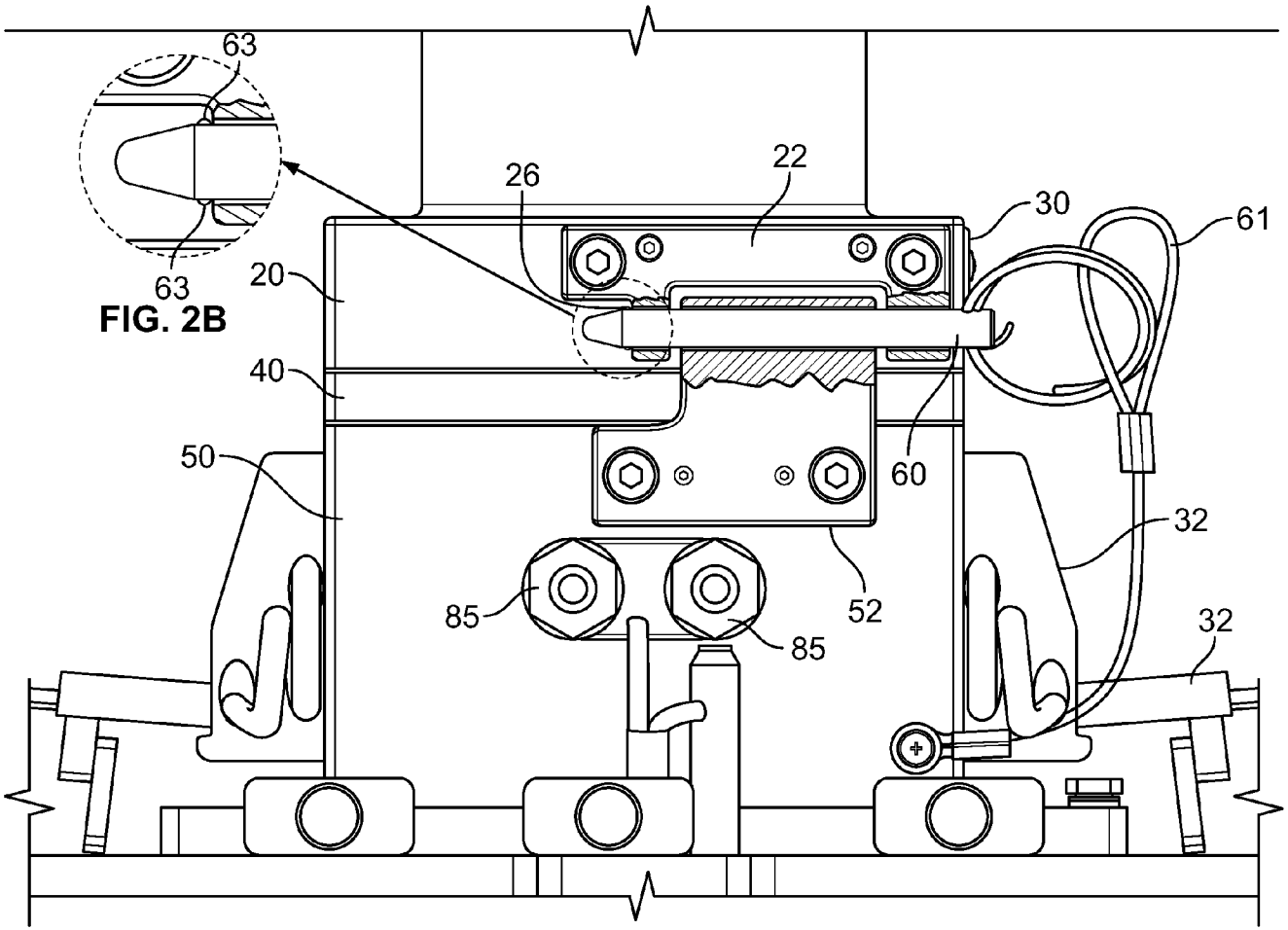
FIGS. 2A and 2B are side elevational views of the firing block/base assembly of FIG. 1, portions of which have been broken away and cross-sectioned to better illustrate a quick release pin which cooperates with additional components of the firing block to impart durability and sustainability over time to the firing block.
Figure 3:
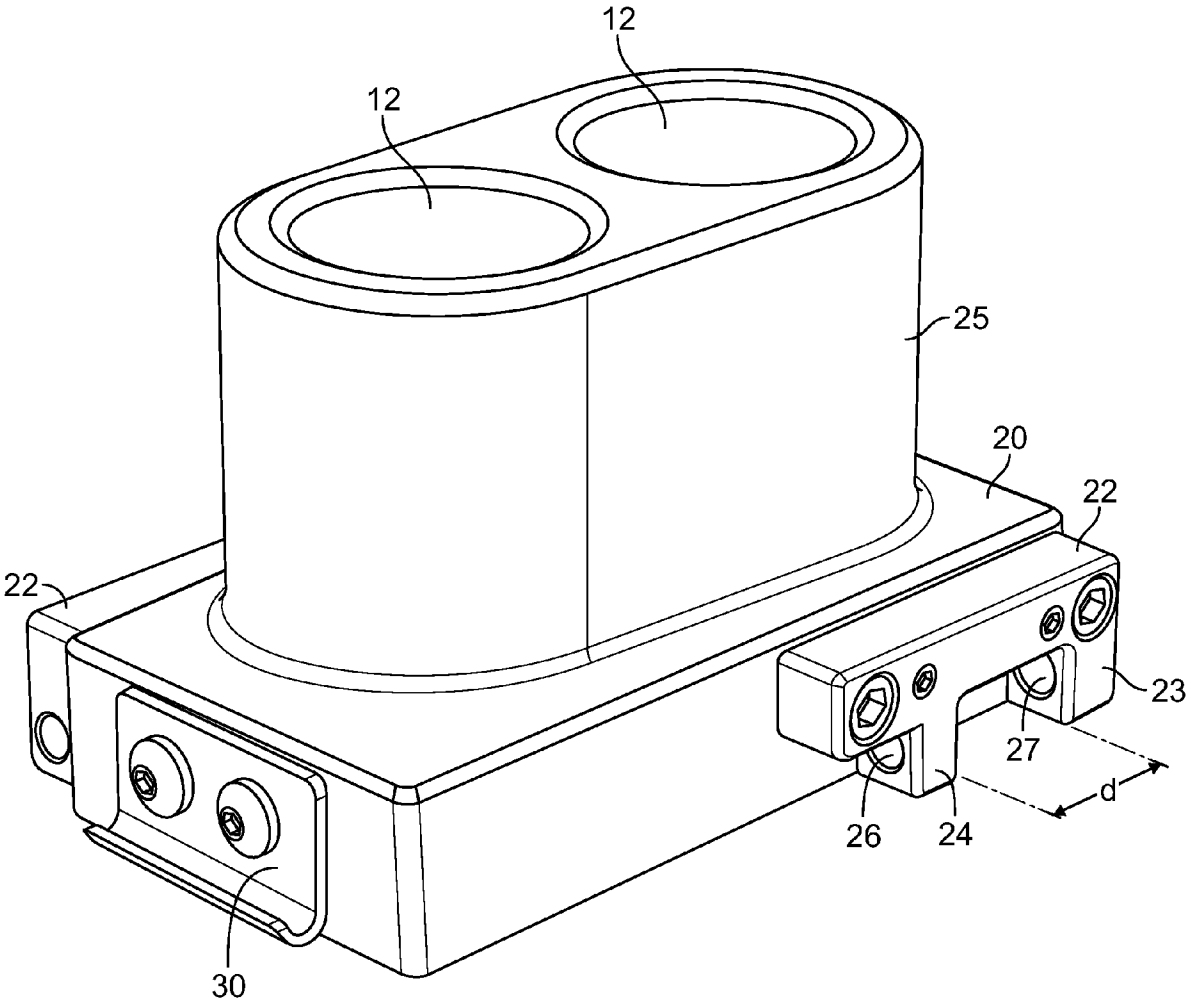
FIG. 3 is a perspective view of a top portion of the firing block shown in FIG. 1.
Figure 4:
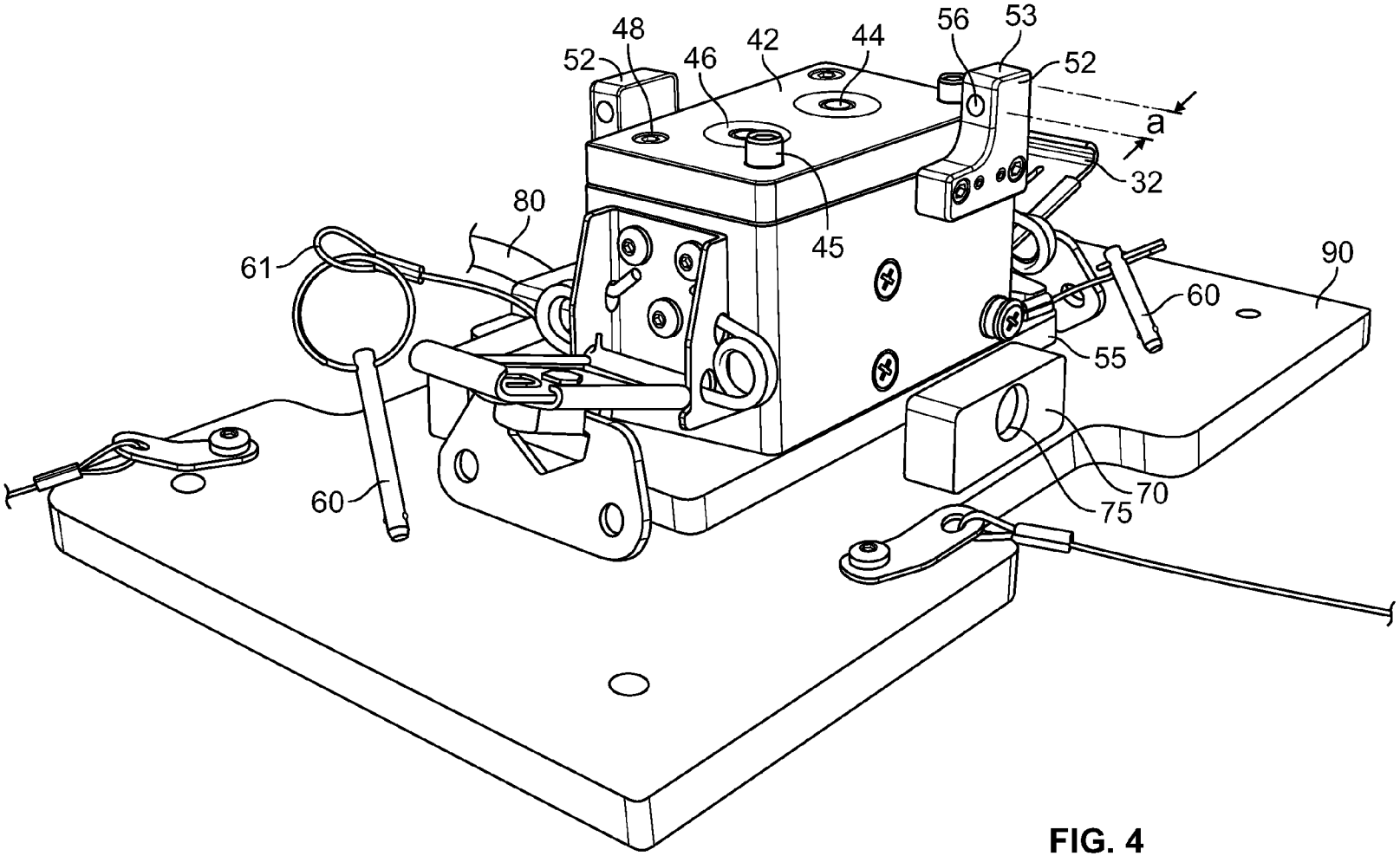
FIG. 4 is a perspective view of the base and a bottom portion of the firing block shown in FIG. 1.

The firing block 10 is designed to repeatedly fire pyrotechnic cartridges during a single and/or multiple training sessions. Even though the latch keepers 30/latch assemblies 32 connect the top portion 20 to the bottom portion 40 and electronic housing 50, a detonation of the pyrotechnic cartridges can cause upwards pressure which can result in the top portion 20 separating from the bottom portion 40, and thus breaking the electrical connection between the pyrotechnic cartridges and the contact assemblies in the bottom portion 40, thereby rendering the firing block 10 inoperable. To inhibit this from transpiring, the firing block 10 is equipped with quick release pins 60, here shown equipped with tether lanyard 61, which, when connected to additional components of the firing block 10, such as machined parts 22 and 52 described further herein, are designed to impart durability and sustainability over time to the firing block 10, see, for example, FIGS. 1 and 2A. As illustrated in FIGS. 2A and 3, a machined part 22 having two arms 23 and 24 of material, each arm 23 and 24 having through holes 26 and 27, respectively, and spaced apart by a distance d, is structurally engaged with at least one outer side surface of the top portion 20. In an embodiment, the machined part 22 is engaged with the outer side surface of the top portion 20 using screws. In the embodiment illustrated, the machined part 22 is provided on the outer surface along the longer length of the top portion 20 (as compared to the latch keepers 30/latch assemblies 32 which are provided on the outer surface along the shorter width of the top portion 20). As illustrated in FIGS. 2A, 2B and 4, a machined part 52 having one arm 53 of material, the arm 53 having a through hole 56 and having a thickness a which is slightly less than the distance d of machined part 22, is structurally engaged with at least one outer side surface of the electronic housing 50. In an embodiment, the machined part 52 is engaged with the outer side surface of the electronic housing 50 using screws. In the embodiment illustrated, the machined part 52 is provided on the outer surface along the longer length of the electronic housing 50 (as compared to the latch keepers 30/latch assemblies 32 which are provided on the outer surface along the shorter width of the electronic housing 50). In the embodiment illustrated, two sets of machined parts 22/52 are positioned diagonally from each other on the firing block 10 (see FIG. 6). It should be understood that the firing block 10, in an embodiment, includes one or more sets of machined parts 22/52.

The machined parts 22 and 52 marry (see, for example, FIG. 2A) so that through holes 26, 27 and 56 create one large through hole for accepting and locking quick release pin 60. In an embodiment, the quick release pins 60 are detent pins with two balls 63 that offer a non-positive lock that pushes in and pulls out of the machined parts 22 and 52. In an embodiment, to insert a detent pin 60 through the through holes 26, 27 and 56 of machined parts 22 and 52, one pushes the detent pin 60 through the through holes 26, 27 and 56 and the locking balls 63 retract into the body of the pin 60 to allow its passage there through. When the detent pin 60 is fully inserted through the through holes 26, 27 and 56, the locking balls 63 are extended by spring force (see, for example, close-up in FIG. 2B) to thereby releasably lock the detent pin 60 in place. When one pulls on the end of the detent pin 60, the spring-loaded locking balls 63 retract so that the detent pin 60 can be removed from the through holes 26, 27 and 56 of the machined parts 22 and 52. An example of such a non-positive lock quick release pin is Avibank Mfg. Inc.'s standard detent pin—no shoulder. In an embodiment, the quick release pins 60 are detent pins with two balls 63 that offer a positive lock that require a push of a button (not shown) to release the balls out of the machined parts 22 and 52. In an embodiment, machine parts 22 and 52 are manufactured from a stainless steel material. In an embodiment, the quick release pins 60 are manufactured from a stainless steel material.

As illustrated in FIG. 4, the bottom portion 40 is attached to an electronic housing 50, which is releasably attached to the base 90. The base 90 includes attachment means 70 having through hole 75, for purpose which are described hereinafter. The bottom portion 40 is made from aluminum and has embedded therein a plurality (two are shown in the embodiment) of contact assemblies which include a center conductive disc 44 and a peripheral conductive disc 46, which in turn are attached to the electronic housing 50. The contact assemblies are in substantial alignment with a corresponding receptacle 12. In an embodiment, peripheral conductive disc 46 is made from electrically conductive rubber, and allows for variations in the length of outer contact posts on different pyrotechnic cartridges. In an embodiment, center conductive disc 44 is made from electrically conductive rubber. In an embodiment, electrical insulation is positioned between the center conductive disc 44 and the peripheral conductive disc 46. Various tapped holes may be provided in the electronic housing 50 to bolt the bottom portion 40 to the electronic housing 50. Some of the components of the contact assemblies form a continuous electrical path from the outside of the assembly 100 to the inside of the electronic housing 50. The electronic housing 50 includes an electromagnetic interference (EMI) filter (not shown) for preventing electrostatic discharge. When the magazine 25, with pyrotechnic cartridges inserted, is engaged to the bottom portion 40, the center contact pin of a pyrotechnic cartridge makes ohmic contact with center conductive disc 44. In an embodiment, the center conductive disc 44 in turn makes ohmic contact with a stainless steel transfer post (not shown), and a stainless steel bridge spring (not shown) completes the electrical path from the stainless steel transfer post to an interface circuit board (not shown) which may reside within or outside of the electronic housing 50. The peripheral conductive disc 46 makes ohmic contact with the outer contact post of a pyrotechnic cartridge and also with the aluminum bottom portion 40 which is electrically common to complete the circuit. In an embodiment (as shown in FIG. 4), the peripheral conductive disc 46 is similar in appearance to a flat washer. The flat washer shape of the peripheral conductive disc 46 enables the operator to insert a pyrotechnic cartridge into the chamber of the magazine 25 with the position of the outer electrode of the pyrotechnic cartridge being orientated anywhere on peripheral conductive disc 46 while always establishing electrical contact with the peripheral conductive disc 46. Nylon flange bushings and nylon sleeves may be used to electrically insulate or isolate the stainless steel transfer post from ohmically contacting the bottom portion 40 or the electronic housing 50. In an embodiment, a non-conductive washer is used to form a seal between the bottom portion 40 and electronic housing 50. Guide bolts 45 located on the bottom portion 40 engage with (i.e., releasable mate or protrude into) bored holes (not visible) located on top portion 20.

Figure 5:
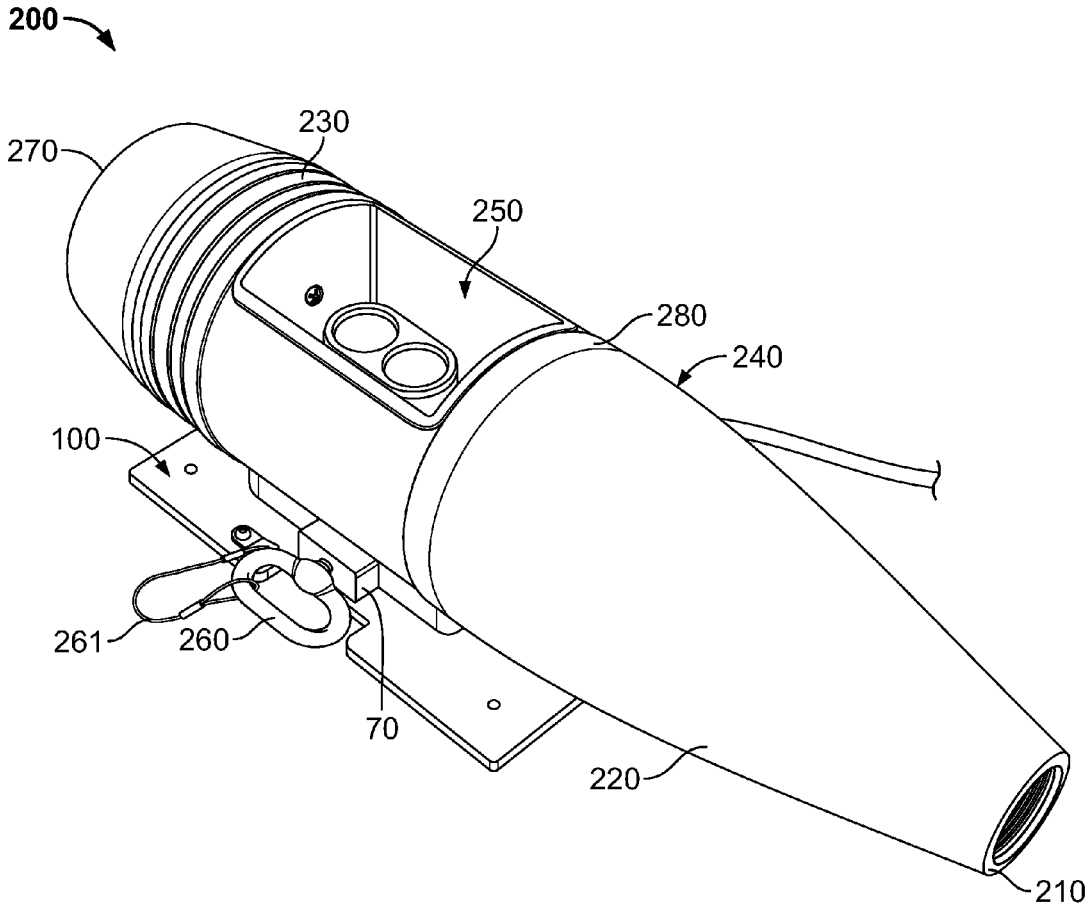
FIG. 5 is a perspective view of an illustrative embodiment of a pyrotechnic IED simulator of the present invention that includes the firing block/base assembly of FIG. 1.
Figure 6:
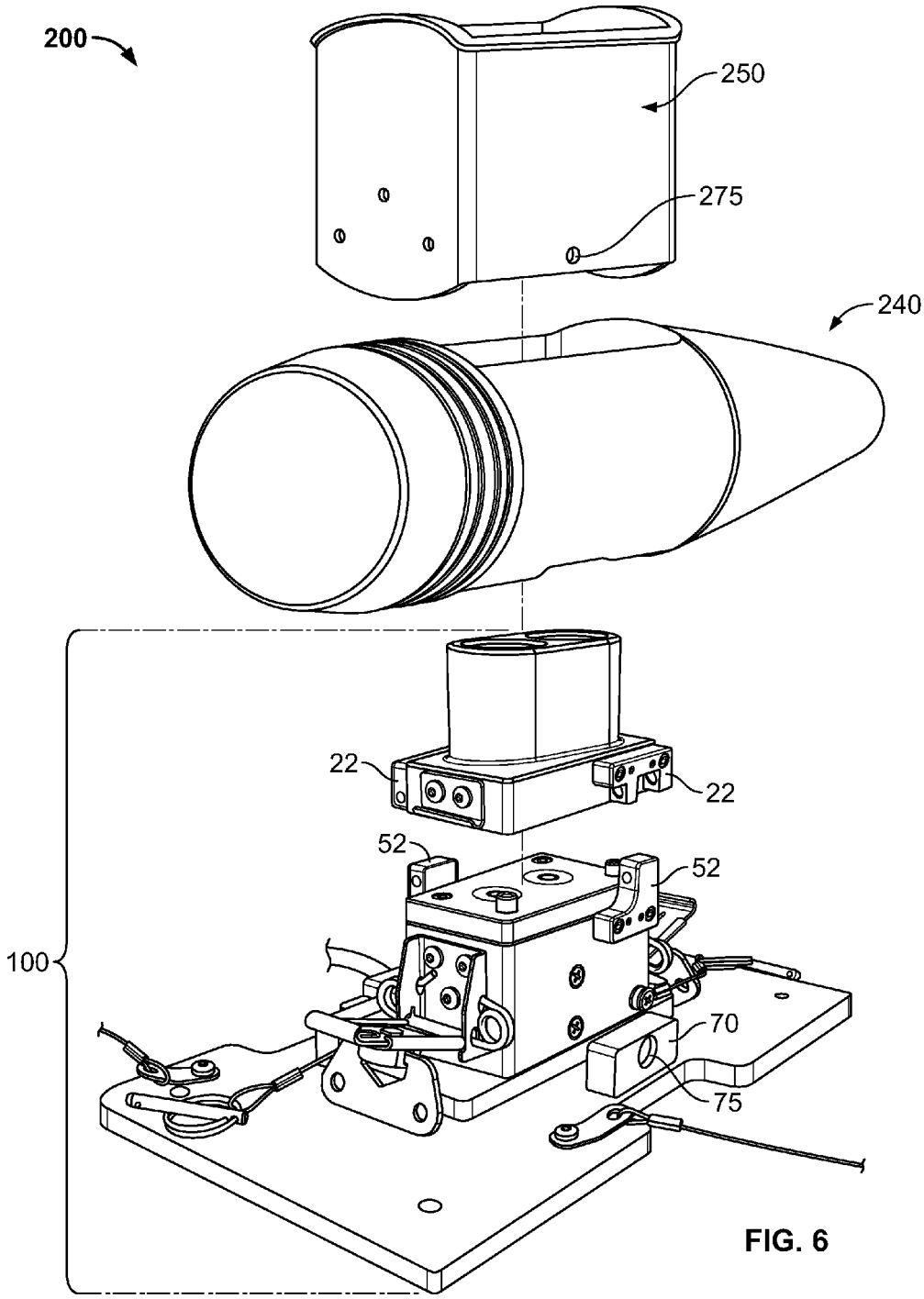
FIG. 6 is an exploded view of the pyrotechnic IED simulator illustrated in FIG. 5.

FIGS. 5 and 6 show an illustrative embodiment of a pyrotechnic IED simulator 200 of the present invention that replicates the explosive effect of an improvised road-side bomb. The pyrotechnic IED simulator 200 includes the assembly 100 of FIG. 1 housed in an artillery shell casing 240 with a blast cavity 250. The artillery shell casing 240 may be designed to include a nose portion 210 (open or closed), an ogive portion 220, a rotating band portion 230 (which can be solid or have grooves), a bourrelet portion 280 and a base portion 270 (with or without a "tracer" cavity). The assembly 100 includes attachment means 70 having through hole 75 (one is clearly visible, two additional attachment means are on the opposite side although any number of attachment means are possible and still within the scope and spirit of the present invention) for connecting the assembly 100 with the blast cavity 250 of the artillery shell casing 240. The blast cavity 250 has a number of through holes 275 that will align with the through holes 75 of the attachment means 70. When positioned together, quick release pins 260, here shown equipped with tether lanyards 261, connect the assembly 100 with the artillery shell casing 240 via the blast cavity 250. In an embodiment, the quick release pins 260 are detent pins with two balls that offer a non-positive lock that pushes in and pulls out. In an embodiment, to insert a detent pin 260 through the through holes 75 and 275 of the attachment means 70 and the blast cavity 250, respectively, one pushes the detent pin 260 through the through holes 75 and 275 and the locking balls retract into the body of the pin 260 to allow its passage there through. When the detent pin 260 is fully inserted through the through holes 75 and 275, the locking balls are extended by spring force to thereby releasably lock the detent pin 260 in place. When one pulls on the end of the detent pin 260, the spring-loaded balls retract so that the detent pin 260 can be removed from the through holes 75 and 275 of the blast cavity 250 and attachment means 70. An example of such a non-positive lock quick release pin is Avibank Mfg. Inc.'s standard detent pin/no shoulder. In an embodiment, the quick release pins 260 are detent pins with two balls that offer a positive lock that require a push of a button to release the balls. The blast cavity 250 channels the blast for maximum sound. In the embodiment illustrated, two (2) pyrotechnic cartridges can be fired simultaneously. In an embodiment, the blast cavity 250 is an aluminum blast cavity which can be anodized but may also be unfinished. In an embodiment, the artillery shell casing 240 is designed to replicate the proportions of a 155 mm artillery shell casing and is manufactured from a polyurethane rubber shell, which is a non-hazardous material with low flammability, having a hollowed out portion for the blast cavity 250. It should be understood that an artillery shell casing 240 of the present disclosure can come in a wide variety of sizes, shapes, and materials to replicate a wide variety of artillery shell casings.

In an embodiment, a pyrotechnic IED simulator of the present invention which is provided for replicating the explosive effect of an improvised road-side bomb includes the assembly 100 of FIG. 1 housed in a tin cooking-oil can with a blast cavity. In an embodiment, a pyrotechnic IED simulator of the present invention which is provided for replicating the explosive effect of an improvised road-side bomb includes the assembly 100 of FIG. 1 housed in a metal can with a blast cavity. In an embodiment, a pyrotechnic IED simulator of the present invention, which is provided for replicating the explosive effect of an improvised road-side bomb, includes the assembly 100 of FIG. 1 housed in a jug with a blast cavity. In an embodiment, a pyrotechnic IED simulator of the present invention which is provided for replicating the explosive effect of an improvised road-side bomb, includes the assembly 100 of FIG. 1 housed in a replica of an animal carcass with a blast cavity. In an embodiment, a pyrotechnic IED simulator of the present invention which is provided for replicating the explosive effect of an improvised road-side bomb, includes the assembly 100 of FIG. 1 housed in a pressure cooker without a blast cavity.

Figure 7:
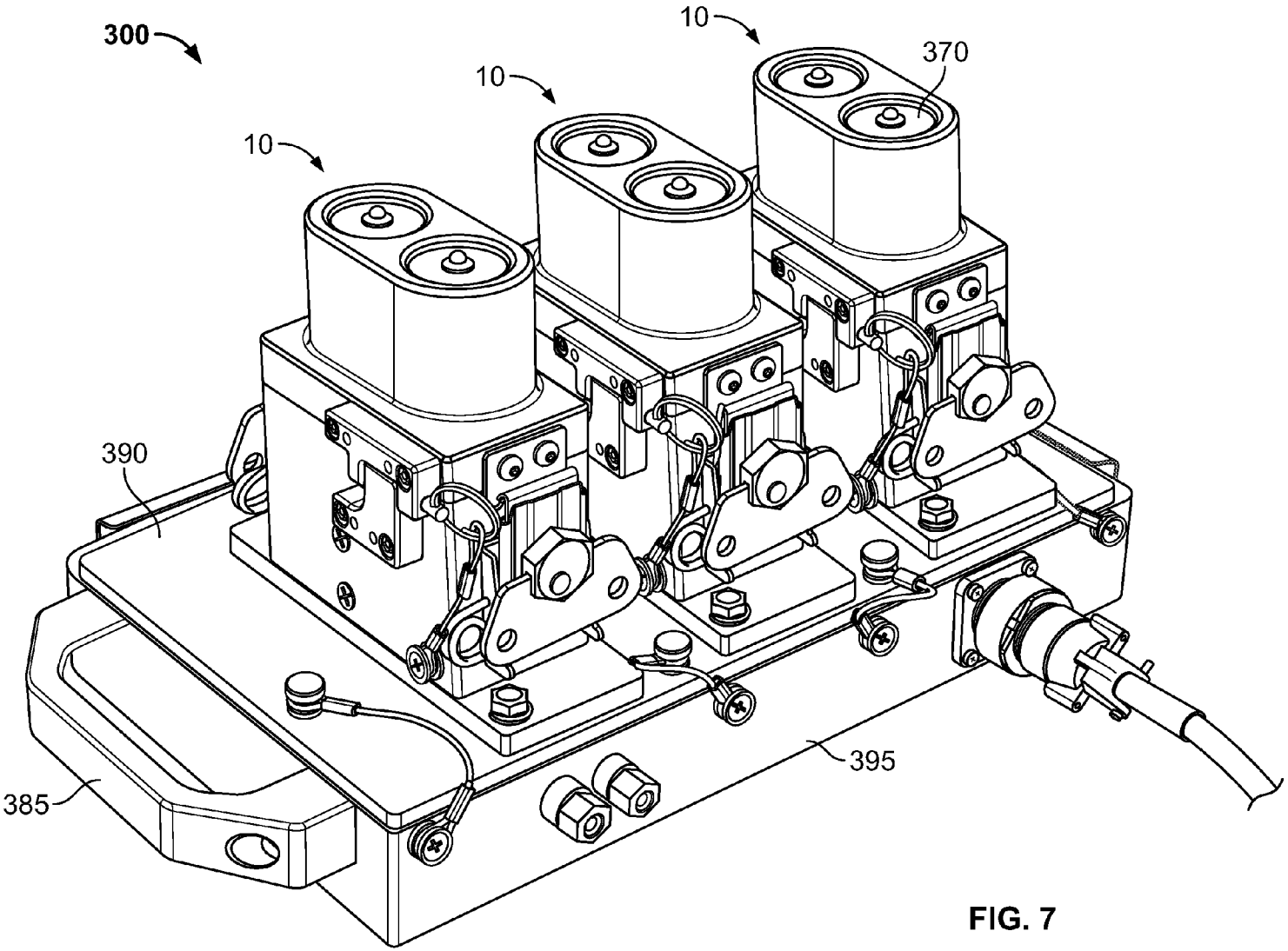
FIG. 7 is a perspective view of an alternative embodiment of a firing block/base assembly constructed in accordance with the present invention.

FIG. 7 shows a perspective view of an alternative embodiment of a firing block/base assembly 300 of the present invention that includes a plurality of firing blocks 10 releasably engaging a base 390, wherein the base 390 includes a handle 385 and a front control panel 395. In an embodiment, the assembly 300 produces a large explosive effect, offering effective, realistic survivability training for combat situations. In an embodiment, the assembly 300 produces realistic visual, audible and concussive effects of an IED in a safe manner. In an embodiment, the front control panel 395 includes at least one of a tandem output connector, a power switch, light emitting diodes (LEDs), an input connector, and a programming connector. The front control power 395 has capabilities for power connection and daisy-chain capability. The handle, 385 may be a black molded nylon handle affixed to a side of the base 390 for ease of mobility. In the embodiment illustrated, the assembly 300 features three firing blocks 10 that can fire a total of six (6) pyrotechnic cartridges 370 simultaneously. In the embodiment illustrated, the pyrotechnic cartridges 370 are LED test light cartridges which test operability during pre-mission checks and troubleshooting. The assembly 300 can be constructed of 100% aluminum. The heavy-gauge aluminum stabilizes the concussive effect of a six-round blast. The rugged design makes the device ideal for extended field training. The assembly 300 can be integrated with other pyrotechnic IED simulators to replicate simultaneous explosive conditions.

A pyrotechnic IED simulator of the present disclosure can include one, two, three, four, five, or any number of firing blocks engaging a base either directly or indirectly. In an embodiment, a pyrotechnic IED simulator of the present disclosure includes one firing block directly engaging a base. In an embodiment, a pyrotechnic IED simulator of the present disclosure includes one firing block indirectly engaging a base via a platform having any desired height so as to "lift" the firing blocks a certain height above the base. In an embodiment, a pyrotechnic IED simulator of the present disclosure includes three firing blocks directly engaging a base. In an embodiment, a pyrotechnic IED simulator of the present disclosure includes three firing blocks indirectly engaging a base via a solid platform having any desired height so as to "lift" the firing blocks a certain height above the base. In an embodiment, a pyrotechnic IED simulator of the present disclosure includes three firing blocks indirectly engaging a base via columnar platforms having any desired height so as to "lift" the firing blocks a certain height above the base.

A pyrotechnic IED simulator of the present disclosure can be used with a trigger box/power pack (for example see 1418 in FIG. 8), which represents a device operable to provide power to the firing blocks, and may include a module for control the operation of the firing blocks. In an embodiment, the power pack comprises components operable to perform the operation of the firing blocks, and may comprise, for example, logic, an interface, memory, other components or combinations thereof. "Logic" may refer to software, hardware, other logic, or combinations thereof, which are able to provide information or instructions. Certain logic may manage the operation of a simulator, and may comprise, for example, a processor. "Processor" may refer to any suitable device operable to execute instructions and manipulate data to perform operations. "Interface" may refer to logic of a device operable to receive input for the device, send output from the device, and perform suitable processing of at least one of the output or input. "Memory" may refer to logic operable to store and facilitate retrieval of information, and may comprise Random Access Memory (RAM), Read Only Memory (ROM), a magnetic drive, a disk drive, a Compact Disc (CD) drive, a Digital Video Disk (DVD) drive, removable media storage, any other suitable data storage medium, or combinations thereof.

The power pack may have multi-triggering user-controlled capabilities that can be switched on or off by a user at anytime during a training simulation (i.e., victim operated (VO)). In such an embodiment, all triggering methods are electronically isolated from one another. The power pack has the ability to initiate detonation in one of three ways: command/hard wired (CW) detonation, radio-controlled (RC) detonation, and victim-operated (VO) detonations, such as a pressure plate/switch, a trip wire, a passive infrared detector, that connect to the power pack via plug and play cable connections to isolated external ports. The power pack also has a jammer plug and shunt plug that can be connected to an interrupter cable, which can be connected to an interrupter box which will disable the power pack. Disabling of the power pack in such a way may be desirable for certain training exercises to simulate a jammer that may be trying to jam the entire electronics of the power pack.

The radio-controlled detonation feature allows a user to enable/disable the victim-operated triggers, while individual control cards within the power pack provide the programming necessary to turn on/off input to the victim operated triggers and various other triggers. Any suitable trigger device operable to detect a trigger event from, for example, a vehicle or a person, and send a trigger signal in response to detecting the event can be used. The power pack has the ability to add on additional devices in a daisy chain method by use of a plug and play output port. The power pack has the ability to initiate via plug and play cable connections. The power pack includes various interfaces for connecting with the various multi-triggering user-controlled capabilities, including, but not limited to, ports which connect with a cable leading to a victim-operated trigger, and ports which connect with a cable leading to a command wire. In an embodiment, the command wire input port cannot be blocked.

An apparatus for simulating an explosive device, in one exemplary embodiment, includes at least one firing block having a top portion including at least one receptacle designed to receive one or more types of pyrotechnic cartridges, a bottom portion embedded with at least one contact assembly in substantial alignment with a corresponding receptacle, and an electronic housing; and a base designed to support each of the firing blocks, wherein each of the firing blocks is equipped with quick release pins, which, when connected to additional components of the firing block, are designed to impart durability and sustainability over time to the firing block. The quick release pins and additional components of the firing block help to maintain intimate contact between the top portion and the bottom portion that is required to allow for passage of electricity between electrical contacts on the pyrotechnic cartridges and respective contact assemblies on the bottom portion, which in turn completes a circuit indicating that the apparatus is properly latched and allowing the circuitry to continue with an arming procedure.

In an embodiment, a victim-operated external triggering device of the present invention can be housed in an artillery shell casing. In an embodiment, a victim-operated external triggering device of the present invention can be housed in a common container, such as a cooking-oil can, with a blast cavity. In an embodiment, a victim-operated external triggering device of the present invention can be housed in a metal can with a blast cavity. In an embodiment, a victim-operated external triggering device of the present invention can be housed in a jug with a blast cavity. In an embodiment, a victim-operated external triggering device of the present invention can be housed in a replica of an animal carcass with a blast cavity. In an embodiment, a victim-operated external triggering device of the present invention can be housed in a pressure cooker. Such an external triggering device is described hereinbelow.

FIGS. 8-14 depict a pyrotechnic IED simulator training system. Elements illustrated in the firing block/base assembly 100 of FIGS. 1-7, which correspond, either identically or substantially, to the elements described above with respect to the embodiment of FIGS. 8-14 have been designated by corresponding reference numerals increased by one thousand. Unless otherwise stated, the embodiments of FIGS. 8-14 are constructed and assembled in the same basic manner as the embodiment of FIGS. 1-7. Elements of the embodiment of FIGS. 8-14 that do not correspond to elements illustrated in FIG. 1-7 are designated with reference numerals that begin with 1400.

Referring to FIGS. 8, 9, 10A and 10B, FIG. 8 is a schematic of a pyrotechnic IED training system 1400 that includes a pyrotechnic IED simulator 1410, which includes a firing block/base assembly 1100 which is similar to the firing block/base assembly 100 discussed with respect to FIGS. 1-4. Reference numbers used for elements that are similar in construction to elements of firing block/base assembly 100 and/or serve similar functions are referenced by the reference numbers used in FIGS. 1-7, incremented by 1000. In the exemplary embodiment of FIGS. 8-9, the firing block base assembly is housed in a casing 1412. The pyrotechnic IED simulator 1410 is interconnected to a victim-operated external decoy triggering device 1414, discussed hereinbelow with respect to FIGS. 10A-10B, which is housed in a casing 1416 (see FIG. 8). The interconnection between the pyrotechnic IED simulator 1410 and the decoy triggering device 1414 is provided through a power pack 1418 (see FIG. 8), which is discussed hereinbelow after the discussion of FIGS. 11-14, which discussion pertains to a pressure-armed trigger module (not shown) residing in the decoy triggering device 1414. It is understood that, while the pyrotechnic IED simulator 1410 and the decoy triggering device 1414 of the pyrotechnic IED training system 1400 are housed in casings 1412, 1416 which are in the form of pressure cookers, the pyrotechnic IED simulator 1410 and/or the decoy triggering device 1414 may be housed in casings made from or emulating other items that may be encountered in the field, such as military ordinance (e.g., the artillery shell cases discussed with respect to FIG. 5), everyday domestic items, vehicles, or even hidden in animal carcasses.

Figure 8:
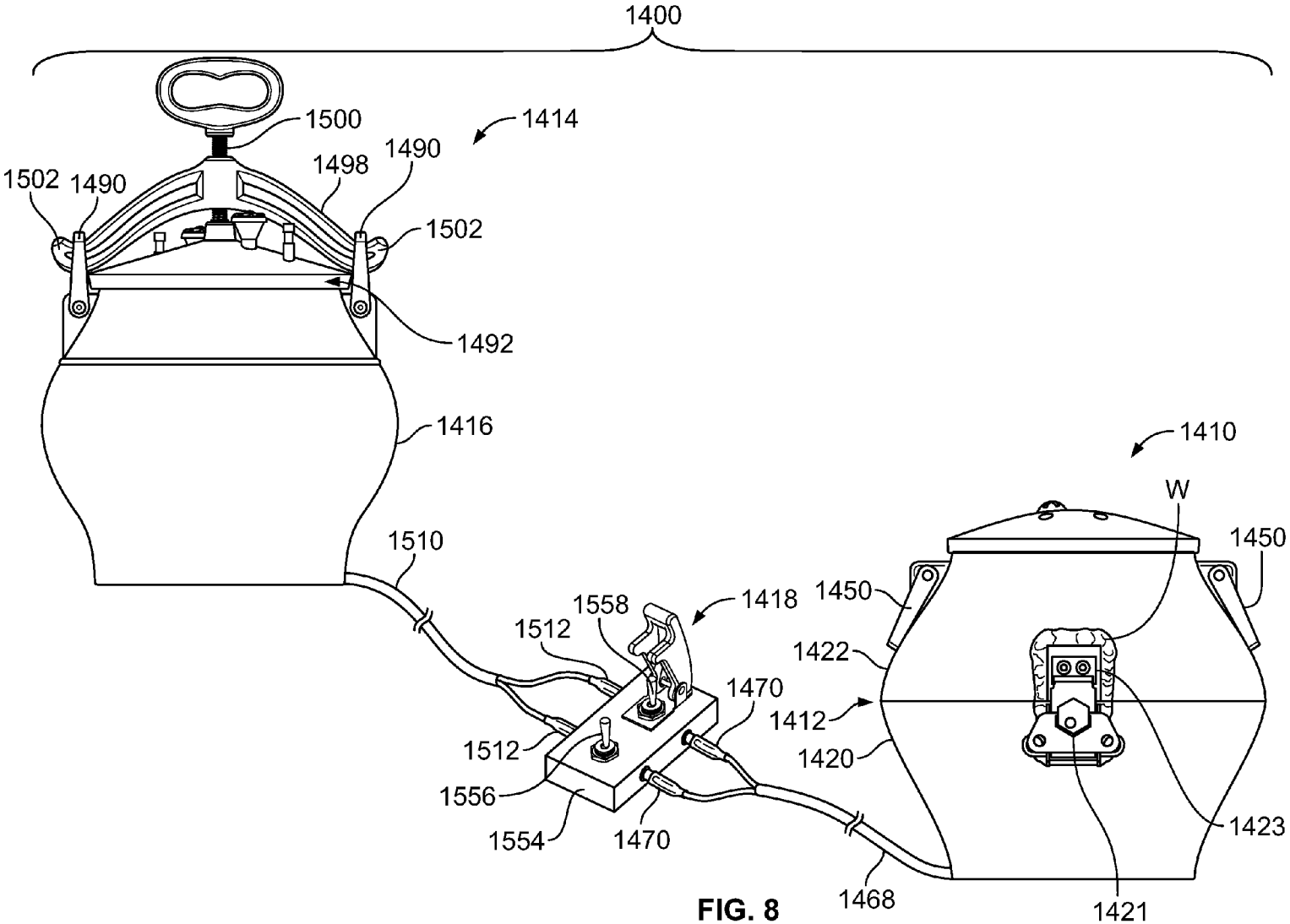
FIG. 8 is a schematic view of a pyrotechnic training system constructed in accordance with an embodiment of the present invention in which an external triggering device is shown connected to a pyrotechnic IED simulator through a power pack.
Figure 9:
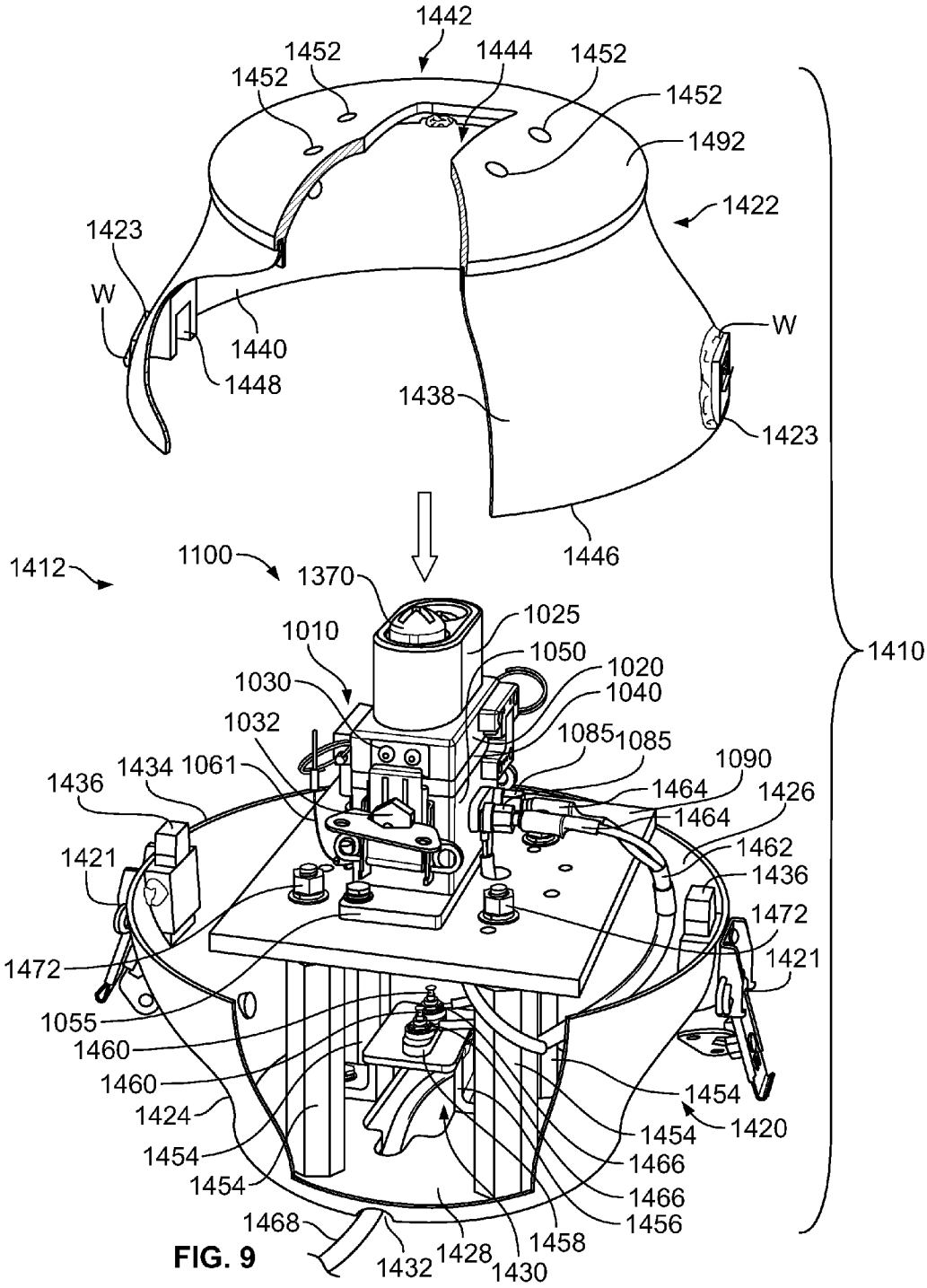
FIG. 9 is an exploded view of the pyrotechnic IED simulator shown in FIG. 8 which has been partially cut-away to show a firing block/base assembly constructed in accordance with the present invention.

Referring to FIGS. 8 and 9, the casing 1412 of the pyrotechnic IED simulator 1410 includes bottom and top portions 1420, 1422 which are shown separated from each other. The bottom portion 1420 has exterior and interior surfaces 1424, 1426 and a base 1428. The base 1428 has a rectangular-shaped opening 1430, and a groove 1432 formed in its exterior surface 1424 for purposes that are described hereinbelow. The bottom portion 1420 has a circular-shaped edge 1434 that is positioned opposite the base 1428. A pair of latch-to-latch assemblies 1421 are positioned opposite each other on the exterior surface 1424 of the bottom portion 1420, and a pair of lugs 1436 are positioned opposite each other on the interior surface 1426 of the bottom portion 1420, such that they are proximate the pair of latch-to-latch assemblies 1421 when top portion 1422 is juxtaposed to bottom portion 1420 (see FIG. 8).

The top portion 1422 of the casing 1412 has exterior and interior surfaces 1438, 1440. A lid 1442 with a rectangular-shaped opening 1444 is permanently attached to the top portion 1422 of the casing 1412. A circular-shaped edge 1446 is located opposite the lid 1442. A pair of latch keepers 1423 are positioned opposite each other on the exterior surface 1438 of the top portion 1422, and a pair of lug-receptacles 1448 are positioned opposite each other on the interior surface 1440 of the top portion 1422, proximate the pair of latch keepers 1423. When the lugs 1436, which are located on the interior surface 1440 of the bottom portion 1420 of the casing 1412, are inserted in the lug-receptacles 1448, the latch keepers 1423 are aligned with the latch-to-latch assemblies 1421 so that the latch keepers 1423 may cooperate with the latch-to-latch assemblies 1421 to connect the top portion 1422 to the bottom portion 1420 (as shown in FIG. 8). In this position, the top portion 1422 is prevented from rotating relative to the bottom portion 1420, and edge 1434 of the bottom portion 1420 and edge 1446 of the top portion 1422 are juxtaposed.

In an embodiment, the casing 1412 may be fabricated from a conventional pressure cooker (not shown) which may be made of cast aluminum. This may be accomplished by cutting the conventional pressure cooker into two parts by using a saw to produce the bottom and top portions 1420, 1422 and the edges 1434, 1446, respectively. The opening 1430 in the base 1428 of the bottom portion 1420 may be formed by the use of a saw, and the groove 1432 may be formed by the use of a grinder. A pair of handles 1450 (see FIG. 8) that facilitate the removable attachment of the conventional lid to the conventional pressure cooker may be left attached to the exterior surface 1438 of the top portion 1422 to preserve the authentic look of the conventional pressure cooker. The lid 1442 may be adapted from the conventional pressure cooker lid (not shown) by removing the safety valves and the handling-knobs from the conventional lid, thereby leaving holes 1452 in the lid 1442.

Alternatively, the casing 1412 and the lid 1442 may be produced from stamped aluminum, or produced from stainless steel. The latch-to-latch assemblies 1421, the latch keepers 1423, the lugs 1436, and the lug receptacles 1448 may be made of aluminum or steel. The lid 1442, the latch-to-latch assemblies 1421, the latch keepers 1423, the lugs 1436, and the lug receptacles 1448 my be permanently fastened to the casings 1412 by welds, such as weld W, or by other suitable fasteners such as glue.

Continuing to refer to FIGS. 8 and 9, a firing block/base assembly 1100, which is provided in the pyrotechnic IED simulator 1410 of the pyrotechnic IED training system 1400, is shown mounted in the bottom portion 1420 of the casing 1412. The firing block/base assembly 1100 is supported on support-posts 1454 which are attached to the base 1428 of the bottom portion 1420. It is understood that the firing block/base assembly 1100 is constructed and operates in substantially the same manner as the firing block/base assembly 100 described hereinabove and depicted in FIGS. 1-4. As discussed, elements of the firing block/base assembly 1100 of FIG. 9 which correspond to elements of the firing block/base assembly of FIGS. 1-4 are identified by the reference numbers used in FIGS. 1-4, incremented by 1000. More particularly, the assembly 1100 includes a firing block 1010 releasably engaging a base 1090. The firing block 1010 includes a top portion 1020, a bottom portion 1040, and an electronic housing 1050 having ports 1085. The electronic housing 1050 is attached to a platform 1055 which releasably engages a base 1090. Latch keepers 1030 cooperate with latch-to-latch assemblies 1032 to connect the top portion 1020 to the bottom portion 1040 and the electronic housing 1050.

The top portion 1020 includes a magazine 1025 having two receptacles 1012. The firing block 1010 can receive an explosive device, such as a pyrotechnic round or cartridge 1370. As described herein above, each of the receptacles 1012 is capable of receiving at least two different types of a US Army type classified round or a non-type classified round that can direct a pyrotechnic explosion in a predetermined direction. The firing block/base assembly 1100 can be constructed of heavy-gauge aluminum to stabilize the concussive effects of the pyrotechnic explosions produced by the discharge of the pyrotechnic cartridge 1370 in the magazine 1025.

The firing block 1010 is designed to repeatedly fire pyrotechnic cartridges during a single and/or multiple training sessions. Even though the latch keepers 1030/latch assemblies 1032 connect the top portion 1020 to the bottom portion 1040 and electronic housing 1050, a detonation of the pyrotechnic cartridges can cause upwards pressure which can result in the top portion 1020 separating from the bottom portion 1040, and thus breaking the electrical connection between the pyrotechnic cartridges and the contact assemblies (not visible) in the bottom portion 1040, thereby rendering the firing block 1010 inoperable. To inhibit this from transpiring, as described hereinabove, the firing block 1010 is equipped with quick release pins (not visible) which are equipped with tether lanyards 1061, which, when connected to additional components of the firing block 1010, are designed to impart durability and sustainability over time to the firing block 1010. In an embodiment, the quick release pins are detent pins with two balls, as described hereinabove and depicted in FIG. 2A.

A bracket 1456 that supports a terminal-block 1458 is mounted on the base 1428 of the bottom portion 1420, proximate the opening 1430. The terminal-block 1458 has a pair of terminal-posts 1460 that protrude upwardly from the terminal-block 1458. A pair of ports (not visible) that protrude downwardly from the terminal-block 1458 are electrically connected to the terminal-posts 1460. A cable 1462, which is equipped with jacks 1464 on one end and ring-terminals 1466 on the opposite end, is provided in the pyrotechnic IED simulator 1410. The jacks 1464 are plugged into the ports 1085 of the electronic housing 1050, and the ring terminals 1466 are screwed onto the terminal-posts 1460 of the terminal-block 1458. A cable 1468, which is equipped with jacks (not visible) on one end, and jacks 1470 (see FIG. 8) on the opposite end, extends from the terminal-block 1458 to the power pack 1418. More particularly, the jacks of the cable 1468 are plugged into and unplugged out of the ports of the terminal block 1458 through the opening 1430 of the base 1428. The cable 1468 is routed through the groove 1432 of the base 1428 so that the pyrotechnic IED simulator 1410 rests evenly on the support surface (e.g., the ground). The cables 1462, 1468 connect a firing block 1010 of the pyrotechnic IED simulator 1410 with the power pack 1418, thus establishing a pathway for communicating a detonation command from the power pack 1418 to the firing block 1010 of the pyrotechnic IED simulator 1410 in a manner that is described hereinbelow.

The firing block/base assembly 1100, the support-posts 1454, and bracket 1456 may be assembled in the bottom portion 1420 in the follow manner: i) the top portion 1422 of the casing 1412 is separated from the bottom portion 1420 by disconnecting the latch-to-latch assemblies 1032 from the latch keepers 1030 and separating the edges 1434, 1446; ii) the bracket 1456 is fastened to the base 1428 of the bottom portion 1420 by screws (not shown) or other suitable fasteners such as welds; iii) the support-posts 1454 are fastened to the base 1428 of the bottom portion 1420 by screws (not visible), on one end, and to the base 1090 of the of the firing block/base assembly 1100 by bolts/washer/nut fasteners 1472 on the opposite end. It is understood that the size, shape and material used for constructing of the support-posts 1454 (e.g., solid metal) are selected to endure the shock waves produced by the discharge of pyrotechnic cartridges 1370 without fatigue or structural weakening over time with repeated use of the firing block 1010. The length of the support-posts 1454 is established so that the top of the magazine 1025 of the firing block/base assembly 1100 is positioned flush with the top of the lid 1442. In this orientation, only the tip of the explosive-end of the pyrotechnic cartridge 1370 is exposed (as illustrated in FIG. 9) so that, when assembled, the pyrotechnic IED simulator 1410 appears deceptively similar to the appearance of a conventional pressure cooker.

Figure 10A:
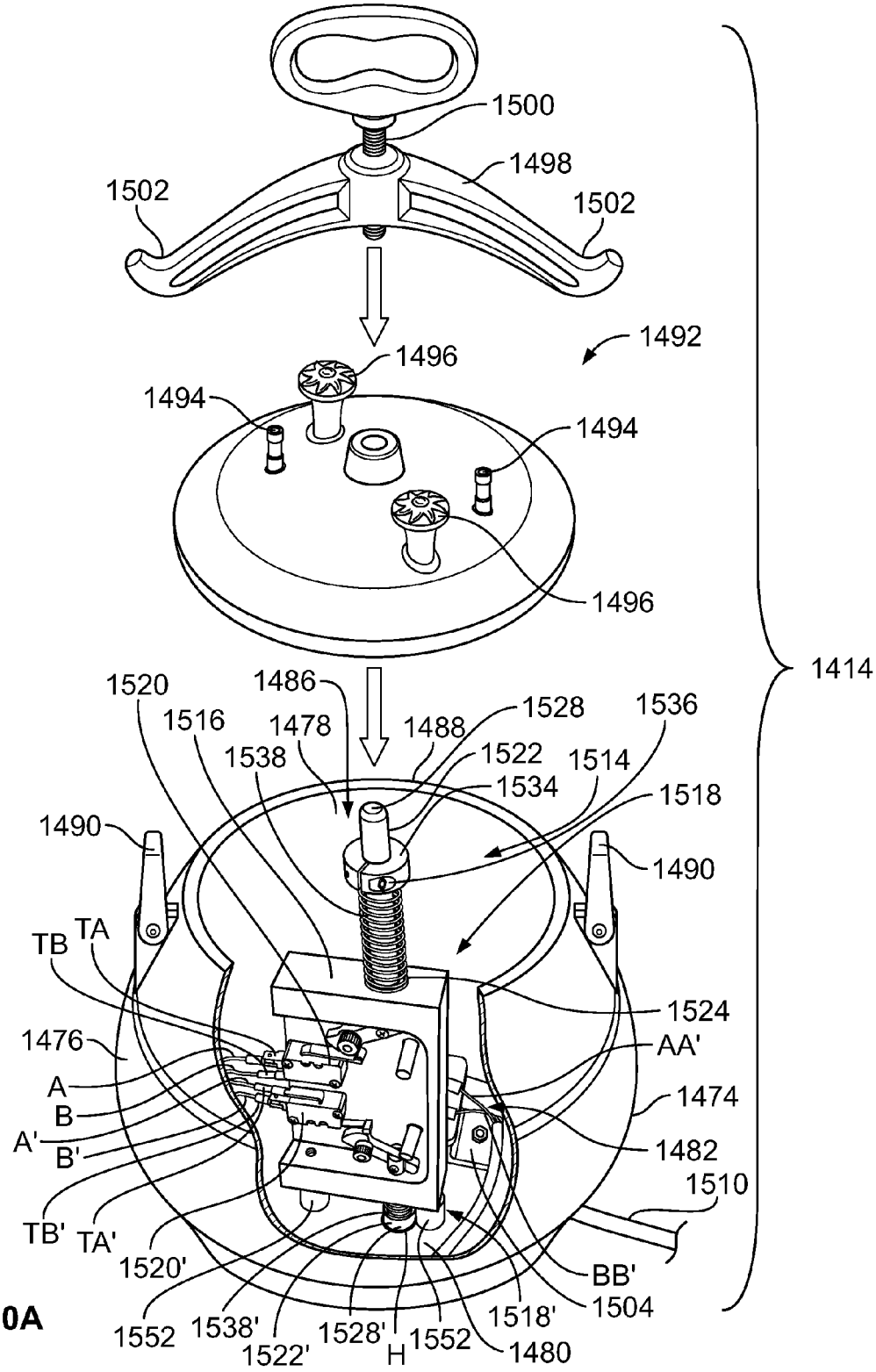
FIG. 10A is an exploded view of the external triggering device shown in FIG. 8, which has been partially cut-away to show a perspective view of a trigger module constructed in accordance with an embodiment of the present invention.
Figure 10B:
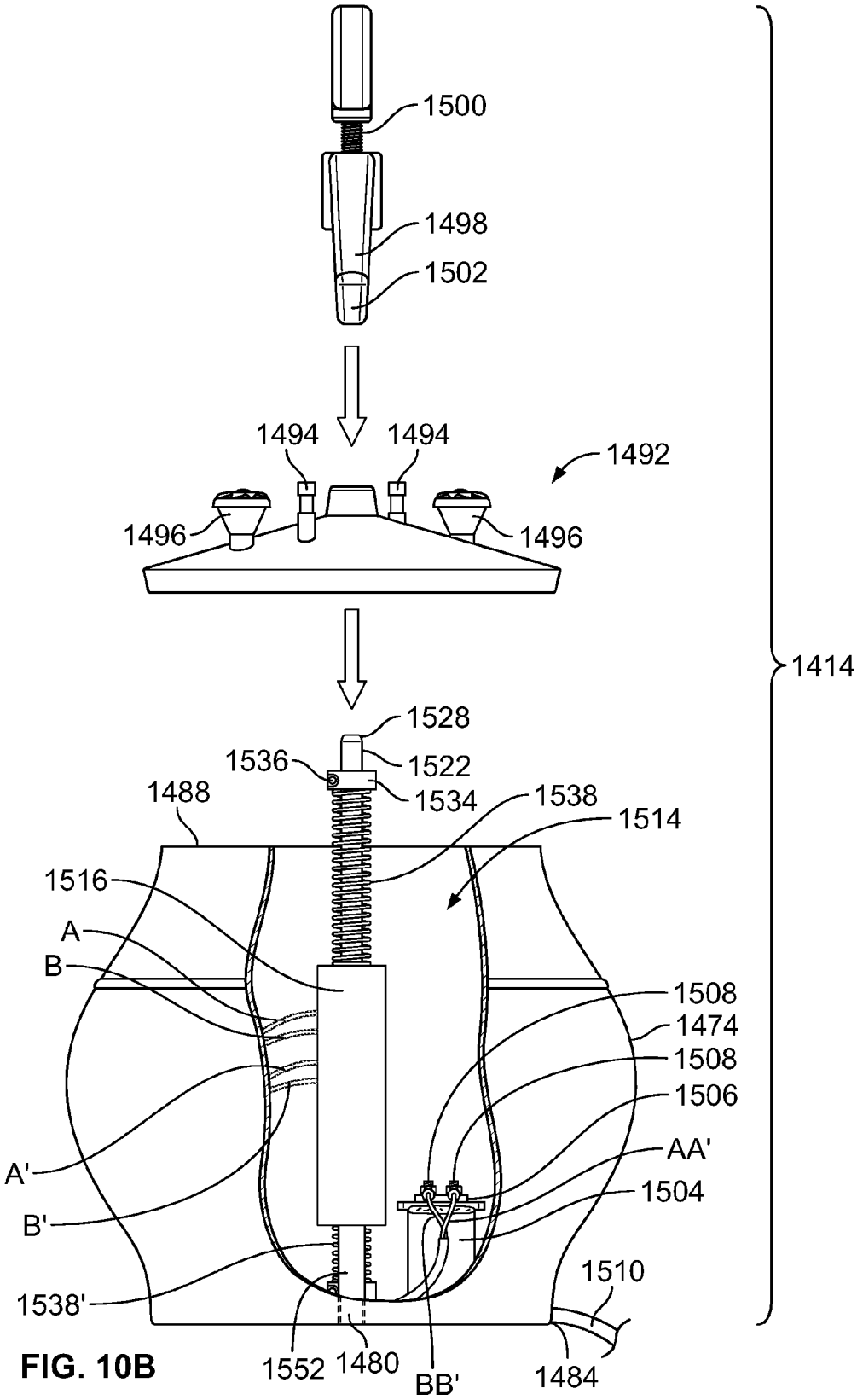
FIG. 10B is an exploded side view of the external triggering device shown in FIG. 8, which has been partially cut-away to show a side view of the trigger module.

Referring to FIGS. 8, 10A and 10B, the decoy triggering device 1414 includes a casing 1474 which is shaped in the form of a conventional pressure cooker. The casing 1474 has exterior and interior surfaces 1476, 1478, and a flat base 1480. The base 1480 has a centrally located hole H, a rectangular-shaped opening 1482 and a groove 1484 (see FIG. 10B) formed therein, for purposes that are described hereinbelow. The casing 1474 has a circular opening 1486 that is bounded by a lip 1488. A pair of opposed hinged U-shaped hooks 1490 are pivotally fastened on the exterior surface 1476 of the casing 1474. A lid 1492, which is removably attachable to the lip 1488 of the casing 1474, has a plurality of safety values 1494 and handling-knobs 1496 mounted thereon. A stirrup 1498, having a centrally located screw 1500 with hooked-shaped ends 1502, is used to retain the lid 1492 on the lip 1488 of the casing 1474. More particularly, with the lid 1492 positioned on the lip 1488 of the circular opening 1486 of the casing 1474 and each of the hooked-shaped ends 1502 of the stirrup 1498 engaged with the hooks 1490 of the casing 1474 (as shown in FIG. 8), the screw 1500 may be screwed down onto the lid 1492 in order to fasten the lid 1492 on the lip 1488. The casing 1474, the lid 1492, and the stirrup 1498 may be fabricated from aluminum or other suitable material such as stainless steel.

Continuing to refer to FIGS. 8, 10A and 10B, a bracket 1504 that supports a terminal-block 1506 is mounted the base 1480 of the casing 1474, proximate the opening 1482. The terminal block 1506 has a pair of terminal-posts 1508 that protrude upwardly from the terminal-block 1506. A pair of ports (not visible) protrude downwardly from the terminal-block 1506 and are electrically connected to the terminal-posts 1508. A cable 1510, which is equipped with jacks (not visible) on one end, and jacks 1512 (see FIG. 8) on the opposite end, extends from the terminal-block 1506 to the power pack 1418. More particularly, the jacks of the cable 1510 may be plugged into and unplugged out of the ports of the terminal block 1506 through the opening 1482 (not visible) of the base 1480. The cable 1510 is routed through the groove 1484 of the base 1480 so that the decoy triggering device 1414 may rest evenly on the support surface (e.g., the ground). The cable 1510 connects the terminal-posts 1508 of the decoy triggering device 1414 with the power pack 1418, thus establishing a pathway for communicating a detonation command from the decoy triggering device 1414 to the power pack 1418 in a manner that is described hereinbelow.

Referring to FIGS. 10 A, 10B and 11-14, a trigger module 1514 having a frame 1516 is mounted in the interior of the casing 1474 of the decoy triggering device 1414. The trigger module 1514 has a lid-trigger mechanism 1518 which is located in the upper portion of the frame 1516 proximate the lid 1492, and a base-trigger mechanism 1518' which is located in the lower portion of the frame 1516 proximate the base 1480 of the casing 1474.

Referring now to FIGS. 11-14, the lid-trigger mechanism 1518 has a micro-switch 1520, and a rod-shaped plunger 1522 that extends through a bore 1524 in the frame 1516 (also see FIG. 10A). An external actuator arm 1526 is pivotally mounted on the micro-switch 1520 and is biased in an extended position (see FIG. 11) from which it may be moved to a depressed position (see FIG. 12). A pair of terminals TA, TB are mounted on the exterior of micro-switch 1520. As described in detail hereinbelow, when the actuator arm 1526 is depressed, the micro-switch 1520 closes the internal path between terminals TA, TB, and vice versa. The manner in which the plunger 1522 is linked to the actuator arm 1526 of the micro-switch 1520 is described hereinbelow.

More particularly, the plunger 1522 is free to slide in and out of the bore 1524 (i.e., in the direction of the longitudinal axis of the bore 1524). The length of the plunger 1522 is sized so that the when the lid 1492 is screwed to the casing 1474, the plunger 1522 is depressed into the frame 1516, and when the lid 1492 is removed from the casing 1474, the plunger 1522 protrudes out of the frame 1516 to its fullest extent, as described hereinbelow. The plunger 1522 has external and internal ends 1528, 1530 (also see FIG. 10A), with a pivot pin 1532 installed proximate the internal end 1530. A collar 1534 that has a set screw 1536 is positioned on the portion of the plunger 1522 that extends exteriorly from the frame 1516. The position of the collar 1534 may be adjusted by the applying the set screw 1536 at the desired location along the exterior portion of the plunger 1522. A spring 1538 that is installed on the plunger 1522 is compressed between the collar 1534 and the frame 1516. The spring 1538 creates a force that acts in the direction of the external end 1528 of the plunger 1522, with a magnitude that is proportional to the distance between the collar 1534 and the frame 1516. Therefore, the spring 1538 biases the plunger 1522 in the direction of the external end 1528 with a force that is based on the position of the collar 1534 on the plunger 1522 (i.e., the closer the collar 1522 is positioned towards the frame 1516, the stronger is the biasing force, and vice versa). In this manner, the biasing force may be adjusted so that, for example, when the stirrup 1498 and screw 1500 are removed from the lid 1492, the weight of the lid 1492 can more than offset the opposing biasing force created on the lid 1492 by the spring 1538. This setting may be advantageous for a particular training scenario, in which the lid 1492 is freely resting on the casing 1474, as described hereinafter.

Continuing to refer to FIGS. 11-14, a pivot-post 1540 and a stop-post 1542 are shown mounted in the frame 1516. A lever 1544 has a rounded-end 1546 and a cam 1548 formed on an end opposite the rounded-end 1546. The lever 1544 has a hole 1550 in which the pivot-post 1540 pivotally anchors the lever 1544 in a seesaw manner. The lever 1544 is pivotally connected to the plunger 1522 by the pivot pin 1532 of the plunger 1522. The lever 1544 is sized and shaped so that when the lid 1492 is removed from the casing 1474, the spring 1538 biases the plunger 1522 in the direction of its external end 1528, the rounded-end 1546 of the lever 1544 rests on the frame 1516, and the cam 1548 of the lever 1544 depresses the actuator arm 1526 of the micro-switch 1520. Having described the mechanical linkages of the lid-trigger mechanism 1518 hereinabove, the electrical circuitry of the lid-trigger mechanism 1518 is now described hereinbelow, including reference to the power pack 1418 described previously with respect to FIG. 8.

Wire leads A and B are attached to terminals TA, TB of the micro-switch 1520, at one end, and are spliced to wire leads AA' and BB' at splices SAA' and SBB' (see FIGS. 11-14) at the opposite end. The wire leads A and B have electrically continuity with the terminal-posts 1508 of the terminal block 1506 (see FIG. 10B). It follows, therefore, that when the actuator arm 1526 is depressed, the micro-switch 1520 closes the internal the path between the leads A and B, which thereby provides a closed circuit across the terminal-posts 1508. Since the cable 1510 connects the terminal-posts 1508 of the decoy triggering device 1414 with the power pack 1418, when the lid 1492 is removed from the casing 1474, the lid-trigger mechanism 1518 provides a closed circuit to the power pack 1418, thus providing a detonation command to the power pack 1418. In this condition, the lid-trigger mechanism 1518 is considered "triggered".

Figure 11:
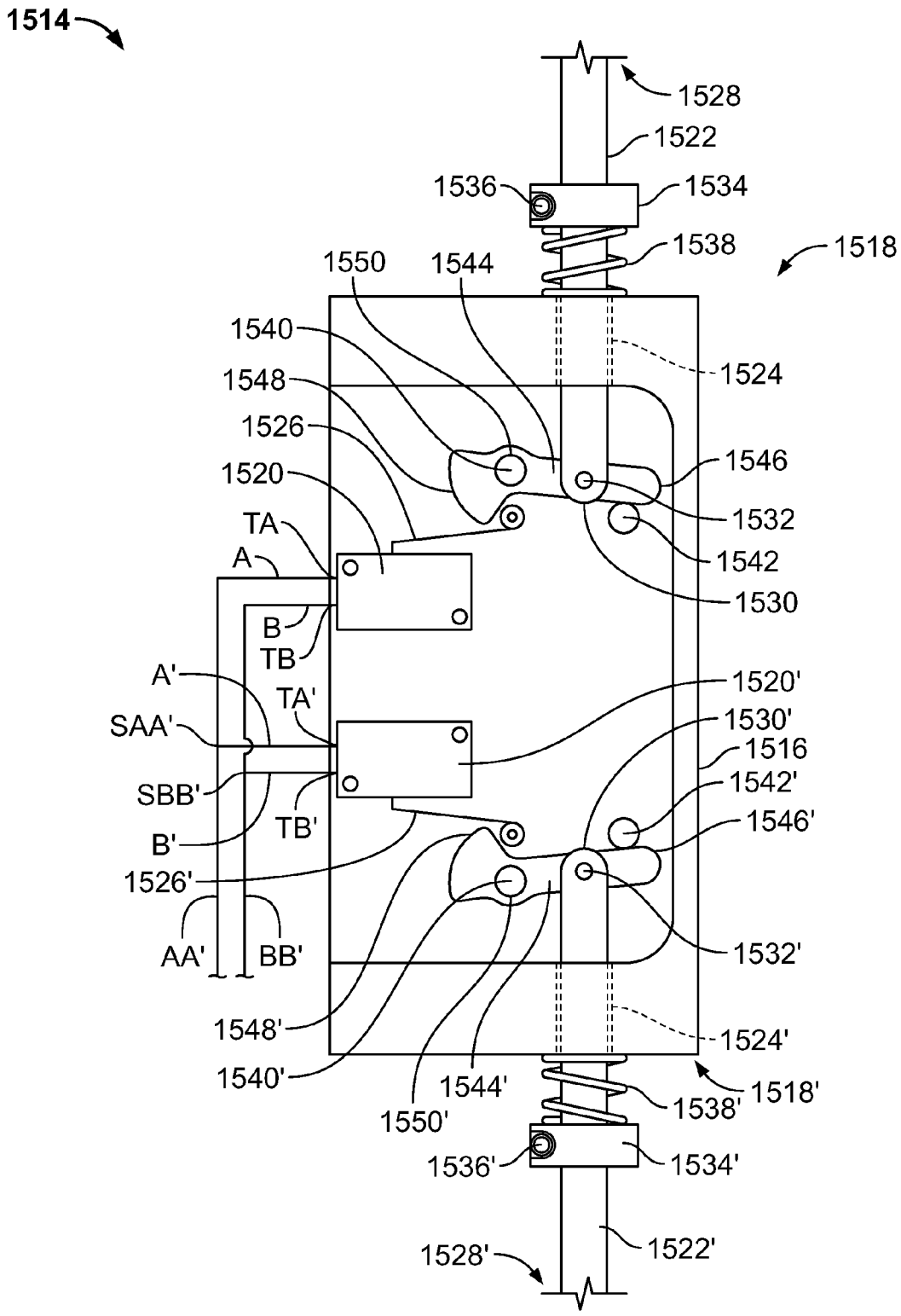
FIG. 11 is a schematic drawing of a front view of the trigger module of FIG. 10A having base (lower) and lid (upper) trigger switches in their armed positions.
Figure 12:
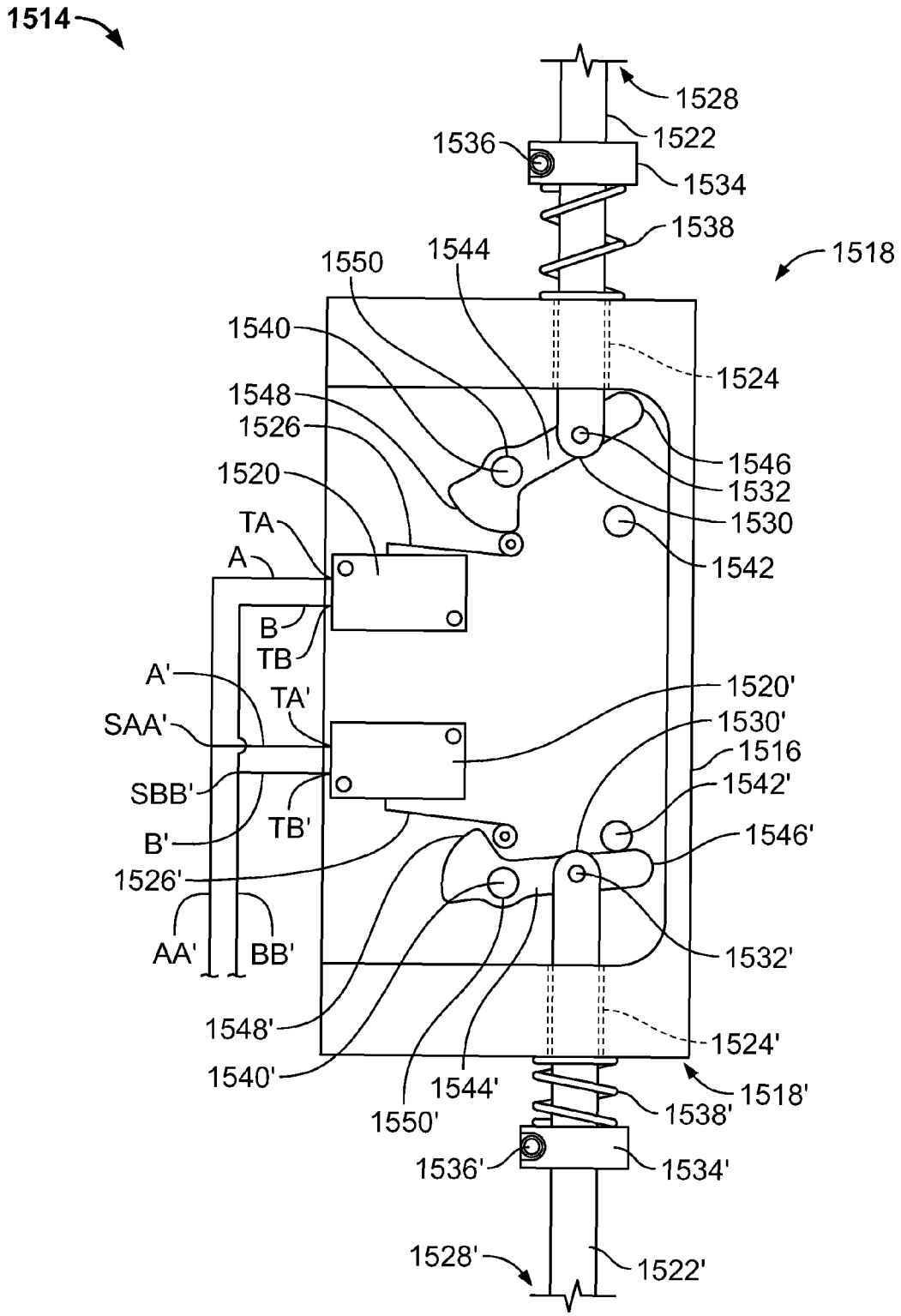
FIG. 12 is a schematic drawing of a front view of the trigger module of FIG. 10A in which the base trigger switch is shown in its armed position and the lid trigger switch is shown in its triggered position.
Figure 13:
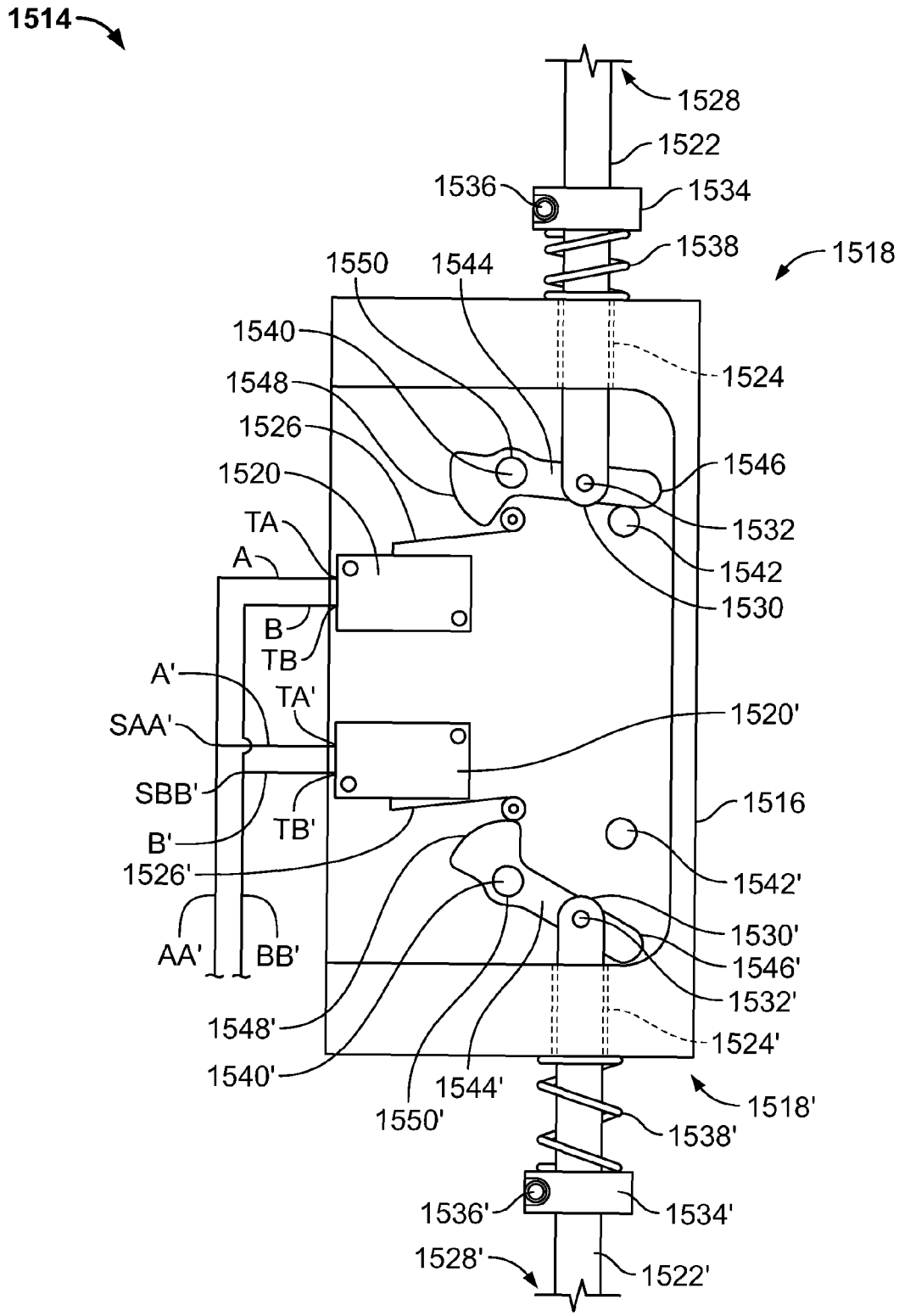
FIG. 13 is a schematic drawing of a front view of the trigger module of FIG. 10A in which the base trigger switch is shown in its triggered position and the lid trigger switch is shown in its armed position.
Figure 14:
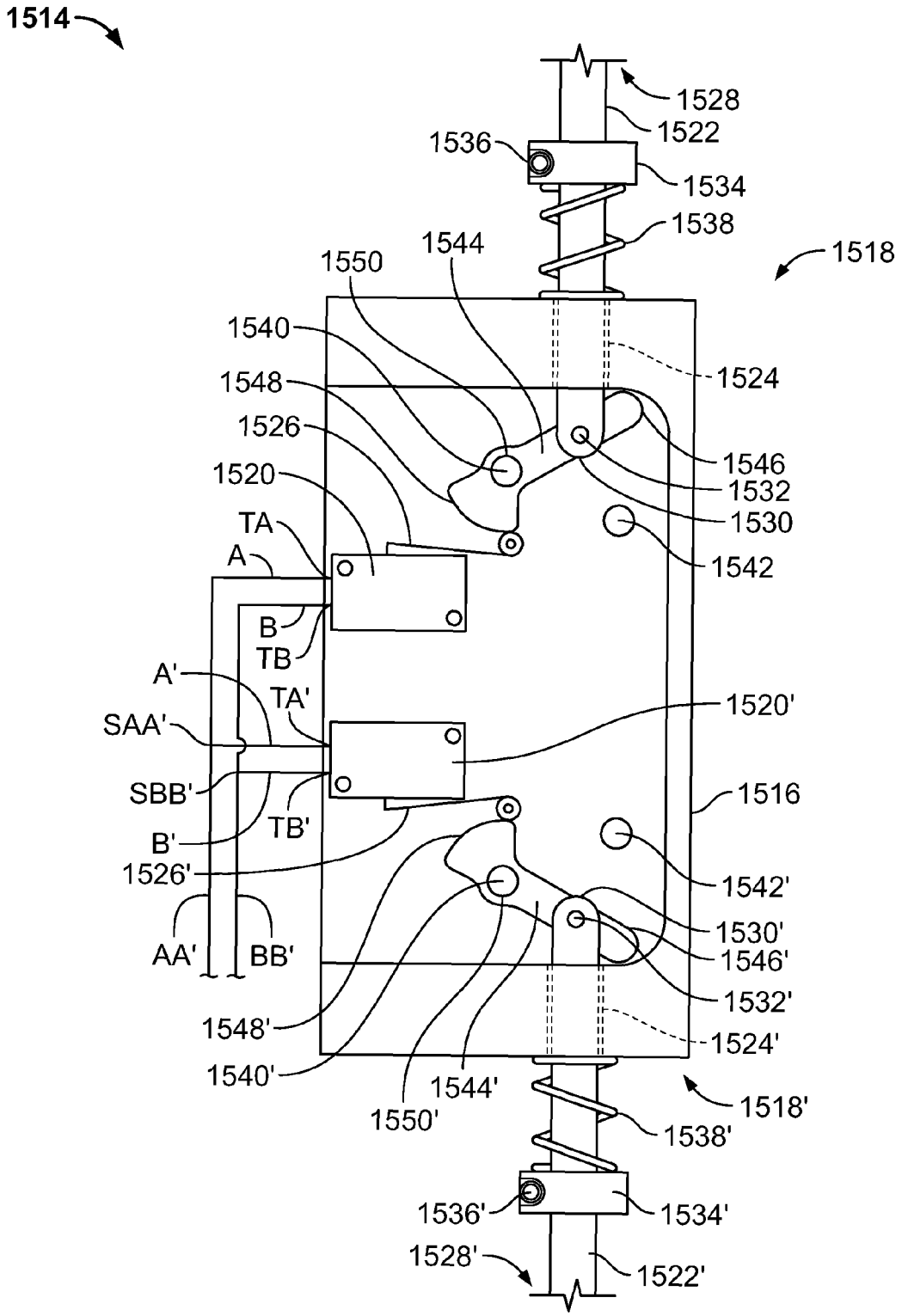
FIG. 14 is a schematic drawing of a front view of the trigger module of FIG. 10A in which the base and lid trigger switches are shown in their triggered positions.

Referring to FIGS. 10A, 10B and 11, when the lid 1492 is fastened to the casing 1474, the plunger 1522 is depressed such that the rounded-end 1546 of the lever 1544 rests on the stop-post 1542, and the cam 1548 of the lever 1544 releases the actuator arm 1526 of the micro-switch 1520. When the actuator arm 1526 is in its released position (i.e., it is not depressed) the micro-switch 1520 opens the internal path between the leads A and B, which thereby provides an open circuit to the terminal-posts 1508, thus disabling a pathway for communicating a detonation command to the power pack 1418. In this condition, the lid-trigger mechanism 1518 is considered "armed".

Since the lid-trigger mechanism 1518 and the base-trigger mechanism 1518' are similarly sized and shaped, elements of the lid-trigger mechanism 1518 that are similar to elements of the base-trigger mechanism 1518' are referred to herein by the reference numerals of the elements similar to those of the lid-trigger mechanism 1518 primed (e.g., "1518'", "1520'", "1530'", etc.).

Accordingly, again referring to FIGS. 11-14, the base-trigger mechanism 1518' has a micro-switch 1520', and a rod-shaped plunger 1522' that extends through a bore 1524' in the frame 1516 (also see FIG. 10A). An external actuator arm 1526' is pivotally mounted on the micro-switch 1520' and is biased in an extended position (see FIG. 11) from which it may be moved to a depressed position (see FIG. 13). A pair of terminals TA', TB' are mounted on the exterior of micro-switch 1520'. When the actuator arm 1526' is depressed, the micro-switch 1520' closes the internal path between terminals TA', TB', and vice versa. The manner in which the plunger 1522' is linked to the actuator arm 1526' of the micro-switch 1520' is described hereinbelow.

When the casing 1474 of the decoy triggering device 1414 is resting on the flat support surface, the plunger 1522' is depressed in the frame 1516. The plunger 1522' has external and internal end 1528', 1530' (also see FIG. 10A), with a pivot pin 1532' installed proximate the internal end 1530'. The external end 1528' may extend through hole H in the abase 1480 of the bottom 1474 of the decoy device 1414. A collar 1534' that has a set screw 1536' is positioned on the portion of the plunger 1522' that extends exteriorly from the frame 1516. The position of the collar 1534' may be adjusted by the applying the set screw 1536' at the desired location along the exterior portion of the plunger 1522'. A spring 1538' which is installed on the plunger 1522' is compressed between the collar 1534' and the frame 1516. The spring 1538' creates a force that acts in the direction of the external end 1528' of the plunger 1522'. Therefore, the spring 1538' biases the plunger 1522' in the direction of the external end 1528' with a force that is based on the position of the collar 1534' on the plunger 1522'.

Continuing to refer to FIGS. 11-14, a pivot-post 1540' and a stop-post 1542' are shown mounted in the frame 1516. A lever 1544' has a rounded-end 1546' and a cam 1548' formed on an end opposite the rounded-end 1546'. The lever 1544' has a hole 1550' in which the pivot-post 1540' pivotally anchors the lever 1544' in a seesaw manner. The lever 1544' is pivotally connected to the plunger 1522' by the pivot pin 1532'. The lever 1544' is sized and shaped so that when the casing 1474 of the decoy triggering device 1414 device is raised up from the support surface, i) the spring 1538' biases the plunger 1522' in the direction of its external end 1528' and the plunger 1522' extends out of the frame 1516 to its fullest extent, and protrudes through the hole H of the base 1480, ii) the rounded-end 1546' of the lever 1544' rests on the frame 1516, and iii) the cam 1548' of the lever 1544' depresses the actuator arm 1526' of the micro-switch 1520'. Having described the mechanical linkages of the base-trigger mechanism 1518' hereinabove, the electrical circuitry of the base-trigger mechanism 1518' is now described hereinbelow, including reference to the power pack 1418 described previously with respect to FIG. 8.

Continuing to refer to FIGS. 11-14, a wire lead A' that is connected to the terminal TA' of the micro-switch 1520' is spliced to the wire lead A at a splice SAA' (for example see FIGS. 11-14) to form a wire lead AA'. The wire lead AA' is connected to the terminal-post 1508 of the terminal block 1506 (see FIG. 10B). A wire lead B' that is connected to the terminal TB' of the micro-switch 1520' is spliced to the wire lead B at a splice SBB' to form a wire lead BB'. The wire lead BB" is connected to the terminal-post 1508 of the terminal block 1506 (e.g., see FIG. 10B). When the actuator arm 1526' is depressed, the micro-switch 1520' closes the internal the path between the leads A' and B', which thereby provides a closed circuit across the terminal-posts 1508. Since the cable 1510 connects the terminal-posts 1508 of the decoy triggering device 1414 with the power pack 1418, when the casing 1474 of the decoy triggering device 1414 is raised from the support surface, the base-trigger mechanism 1518' provides a closed circuit to the power pack 1418, thus providing a detonation command to the power pack 1418. In this condition, the base-trigger mechanism 1518' is considered "triggered".

Referring to FIGS. 10A, 10B and 11, when the base 1480 of the casing 1474 is resting on a flat support surface, the plunger 1522' is depressed such that the rounded-end 1546' of the lever 1544' rests on the stop-post 1542', and the cam 1548' of the lever 1544' releases the actuator arm 1526' of the micro-switch 1520'. When the actuator arm 1526' is in its released position (i.e., it is not depressed) the micro-switch 1520' opens the internal path between the leads A' and B', which thereby provides an open circuit to the terminal-posts 1508, thus disabling a pathway for communicating a detonation command to the power pack 1418. In this condition, the base-trigger mechanism 1518' is considered "armed".

The trigger module 1514 may be mounted to the base 1480 of the casing 1474 with legs 1552. The legs 1552 are fastened to the base 1480 and the frame 1516 by fastening means such as screws (not shown). The micro-switches 1520, 1520' may be of conventional types known in the art. Elements of the lid-triggering mechanism 1518 and the base-triggering mechanism 1518; other than the spring 1538, 1538', may be fabricated from plastic material and formed by injection molding or other conventional method. Alternatively, these element may be fabricated out of other suitable material such as metal.

As described hereinabove, the power pack 1418 may have multi-triggering user-controlled capabilities that can be switched on or off at anytime during a training simulation. The power pack 1418 has the ability to initiate detonation in one of three ways: command/hard wired (CW) detonation, radio-controlled (RC) detonation, and victim-operated (VO) detonations. The power pack may also have a jammer plug and shunt plug that can be connected to an interrupter cable, which can be connected to an interrupter box which will disable the power pack. Disabling of the power pack in such a way may be desirable for certain training exercises to simulate a jammer that may be trying to jam the entire electronics of the power pack.

The power pack 1418 equipped for victim-operated (VO) detonations is depicted and described hereinbelow for the purpose of describing the operation of the pyrotechnic IED training system 1400. It is understood, nonetheless, that the power pack 1418 may be equipped with any and all of the multi-triggering controlled capabilities.

Referring to now to FIG. 8, in an embodiment, the power pack 1418 has a case 1554 which houses a power supply (not shown) such as a 12-volt motorcycle battery. The case 1554 may be fabricated out of any suitable material such as plastic, metal, and/or wood. The case 1554 has an activation-switch 1556 that has first and second positions. In the first or "ON" position, the power supply is connected to the circuit provided by cable 1510 which in turn is connected to the circuit provided by cable 1468. Since the circuit provided by cable 1510 is connected to the circuit provided by cable 1468 in the "ON" position, any "triggered" condition of the decoy triggering device 1414 will initiate a detonation of the pyrotechnic cartridge 1370. In the second or "OFF" position, the power supply is not connected to the circuit provided by cable 1510, and the circuit provided by cable 1510 is not connected to the circuit provided by cable 1468. It is understood that, with appropriate circuitry and cabling modifications to the decoy triggering device 1414 (not described herein), the activation-switch 1556 can alternately be a three 3-way switch so that: i) either the lid-trigger mechanism 1518 or the base-trigger mechanism 1518' can be active, or ii) both the lid-trigger mechanism 1518 and the base-trigger mechanism 1518' can be active, or iii) neither the lid-trigger mechanism 1518 nor the base-trigger mechanism 1518' can be active. The case 1554 also has a safety-switch 1558 that has a first position that disconnects the power supply from the power pack 1418, and a second position that connects the power supply to the power pack 1418.

Operation of the Pyrotechnic IED Training System

In operation, the pyrotechnic IED training system 1400 is setup, and the training session is conducted, with safety precautions employed because close proximity to the discharge of the pyrotechnic cartridge 1370 can result in injury. Therefore, safety steps are employed to prevent an unintended or accidental discharge of the pyrotechnic cartridge 1370. In this regard, it is understood that the use of term "user" herein applies to one or more people or personnel (e.g., military or police personnel) who utilize the IED pyrotechnic training system 1400 to receive training on identifying IEDs and homemade explosives and reacting to their effects in real-time simulations, and the use of the term "operator" herein applies to one or more people or personnel who operate the pyrotechnic IED training system 1400 to enable the users to effectively receive training on identifying IEDs and homemade explosives and reacting to their effects in real-time simulations.

Setting Up the Pyrotechnic IED Training System

The following steps may be conducted by an operator trained in safely operating the pyrotechnic IED training system 1400. For instance, in setting up the pyrotechnic IED training system 1400, the operator may turn the safety switch 1558 of the power pack 1418 to the "OFF" position, and may also disconnect the jacks 1470 of the cable 1468 from the power pack 1418, to prevent an accidental discharge of the pyrotechnic cartridges 1370, during the loading and unloading of the pyrotechnic cartridges 1370 into an and out of the magazine 1025 of the firing block 1010.

The victim operated decoy triggering device 1414 may be positioned in a room of a building, and the pyrotechnic IED simulator 1410 may be placed outside the training building in a secure area (i.e., for safety reasons). The power pack 1418 may be placed in an area that is under the control of the operator.

The after safety measures (e.g. such as those described above) are employed, the following steps may be performed by the operator: (i) the top portion 1422 is removed from the bottom portion 1420 of the casing 1412; (ii), the top portion 1020 is separated from the bottom portion 1040 of the firing block 1010 by separating the latch-to-latch assemblies 1032 from the latch keepers 1030 and by removing (i.e., withdrawing) the quick release detent pins with two balls (i.e., as described hereinabove and depicted in FIG. 2A); and (iii) the cartridges 1370 are loaded in the magazine 1025 of the firing block 1010. Once the cartridges 1370 are loaded in the magazine 1025 of the firing block 1010: (iv) the top portion 1422 is positioned on the bottom portion 1420 of the casing 1412, (v) the top portion 1020 is joined to the bottom portion 1040 of the firing block 1010 by latching the latch-to-latch assemblies 1032 to the latch keepers 1030 and inserting the detent pins, (vi) the jacks 1470 of the cable 1468 are connected to the power pack 1418, and (vii) the safety switch 1558 of the power pack 1418 is turned to the "ON" position. At this point, the pyrotechnic IED training system 1400 is ready to conduct training scenarios, as described below.

Conducting Training Scenarios with the Pyrotechnic IED Training System

In an embodiment, the trainee (i.e., the victim) may handle the decoy triggering device 1414, thereby inadvertently triggering the discharge of the pyrotechnic IED simulator 1410. For instance, in the event that the user suspects that the triggering device 1414 should not be lifted, he/she may nonetheless kick the decoy triggering device 1414 and inadvertently activate the discharge the pyrotechnic IED simulator 1410 by disturbing the base-trigger mechanism 1518'. In the event that the user suspects that the decoy triggering device 1414 should not be touched at all, the user will take steps to avoid touching the decoy triggering device 1414 himself/herself, but may send in a robot or explosive device expert which might disturb the decoy triggering device 1414. Whoever/whatever interrogates the decoy triggering device 1414 may inadvertently activate the pyrotechnic IED simulator 1410. Through these and many other possible training scenarios, the pyrotechnic IED training system 1400 safely provides the trainee with practical education on the consequences of poor situational awareness of the risks and dangers that are present in the real world hostile environments in which the user may operate.

It should be appreciated that the present invention provides numerous advantages. For instance, the decoy triggering device 1414 may be disguised as an article or implement which is native to the environment in which the user may operate. In addition, the routing of the cable 1468 through the groove 1432 of the pyrotechnic IED simulator 1410 readily conceals the cable 1468 for training purposes because the base 1428 of the pyrotechnic IED simulator 1410 rests flush with the support for the pyrotechnic IED simulator 1410 (e.g., the ground) and the external portion of the cable 1468 may be covered with soil, leaves, etc.). Furthermore, the opening 1430 of the base 1428 and the orientation of the downwardly facing ports of the terminal-block 1458 enable the user to conveniently connect/disconnect the jacks of the cable 1468 into and out of the terminal-block 1458. This arrangement facilitates the disconnection of the cable 1468 from the pyrotechnic IED simulator 1410, as one of a number of safety procedures, to prevent an accidental discharge of the pyrotechnic cartridges 1370 during the loading and unloading of the pyrotechnic cartridges 1370 into an and out of the magazine 1025 of the firing block 1010. The same features pertain to the routing of the cable 1510 through the groove 1484 of the decoy device 1414 and the connection/disconnection of the cable 1510 from the terminal block 1506 of the decoy device 1414.

It should be noted that the present invention can have numerous modifications and variations. For instance, while the decoy triggering device 1414 and/or the pyrotechnic IED simulator 1410 of the present invention can be housed in a pressure cooker, in an embodiment, they may alternatively be housed in the casing of other items such as a cooking-oil can, a metal can, a jug, an animal carcass, an artillery shell, or other item that may be native to the environment in which the user may operate.

It should be understood that the embodiments described herein are merely exemplary and that a person skilled in the art may make many variations and modifications without departing from the spirit and scope of the invention. For instance, all such variations and modifications are intended to be included within the scope of the invention as defined in the appended claims.

We claim:

1. A pressure-armed trigger system, comprising a frame having a first member at a first end of said frame, a second member at a second end of said frame, said first and second ends being opposite each other, and a third member extending from said first member to said second member, said first, second and third members defining a recess in said frame, said first and second members having respective first and second bores therethrough, said first and second bores opening into said recess, said respective first and second bores having respective first and second longitudinal axes, said respective first and second longitudinal axes being substantially parallel to each other;

a first electrical circuit having a first electrical switch therein, said first electrical switch having a first actuator movable between a first position in which said first electrical circuit is open and a second position in which said first electrical circuit is closed, said first actuator being biased to said first position such that said first electrical switch is normally open;

a first lever in the recess of said frame and proximate said first member, said first lever having first and second ends opposite each other and a first pivot pin adjacent said third member and between said first and second ends of said first lever, said first lever pivotable about said pivot pin between a first position and second position, wherein said first lever, said first pivot pin, and said first actuator are arranged such that, in said first position of said first lever, said first actuator is in its first position, and, in said second position of said first lever, said second end of said first lever presses upon said first actuator such that said first actuator is in its second position;

a first rod residing in said first bore and reversibly movable therein along the first longitudinal axis, said first rod having a first end external to said frame and a second end opposite said first end of said rod and residing within said recess of said frame, said first lever rotatably connected to said second end of said first rod at a location between said first pivot pin and one of said ends of said first lever;

a first helical spring having first and second ends opposite each other, said first end of said first spring adjacent said first member of said frame, with said first rod residing in the interior of said first spring and movable therein along the first longitudinal axis;

a first collar affixed to said first rod and adjacent said second end of said first spring, said first rod, said first collar, said first spring and said first lever being arranged such that applying pressure to said first end of said first rod along the first longitudinal axis moves said first rod so as to compress said first spring and move said first lever to its said first position, and removing the pressure from said first end of said first rod allows said first spring to expand thus moving said first rod so as to move said first lever to its said second position;

a second electrical circuit having a second electrical switch therein, said second electrical switch having a second actuator movable between a third position in which said second electrical circuit is open and a fourth position in which said second electrical circuit is closed, said second actuator being biased to said third position such that said second electrical switch is normally open;

a second lever in said recess of said frame and proximate said second member, said second lever having third and fourth ends opposite each other and a second pivot pin adjacent said third member and between said third and fourth ends of said second lever, said second lever pivotable about said second pivot pin between a third position and fourth position, wherein said second lever, said second pivot pin, and said second actuator are arranged such that, in said third position of said second lever, said second actuator is in its first position, and, in said fourth position of said second lever, said fourth end of said second lever presses upon said second actuator such that said second actuator is in its fourth position;

a second rod residing in said second bore and reversibly movable therein along the second longitudinal axis, said second rod having a third end external to said frame and a fourth end opposite said third end of said rod and residing within said recess of said frame, said second lever rotatably connected to said fourth end of said second rod at a location between said second pivot pin and said third end of said second lever;

a second helical spring having third and fourth ends opposite each other, said third end of said second spring adjacent said second member of said frame, with said second rod residing in the interior of said second spring and movable therein along the second longitudinal axis;

a second collar affixed to said second rod and adjacent said fourth end of said second spring, said second rod, said second collar, said second spring and said second lever being arranged such that applying pressure to said third end of said second rod along the second longitudinal axis moves said second rod so as to compress said second spring and move said second lever to its said third position, and removing the pressure from said third end of said second rod allows said second spring to expand thus moving said first rod so as to move said first lever to its said second position.

2. The trigger system of claim 1, further comprising a container having a first portion and a second portion adjacent each other so as to define an interior of said container, wherein said frame is secured within said second portion such said first portion applies pressure to said first end of said first rod such that said first lever is in its first position with said second portion resting on a surface.

3. The trigger system of claim 2, said second portion defining an opening opposite said first portion, said opening accessible to said third end of said second rod such that said third end of said second rod extends therethrough such that, with said second portion of said container resting on a surface, said surface applies pressure to said third end of said second rod such that said second lever is in its third position.

4. The trigger system of claim 1, further comprising first and second stop posts in said recess of said frame, said first stop pin arranged so that said first end of the said first lever rests on said first stop post when said first lever is in its first position, and said second stop post arranged so that said third end of said second lever rests on said second stop post when said second lever is in its third position.

5. The trigger system of claim 1, wherein said second end of said first lever includes a first cam arranged so that, when said first lever is in its second position, said first cam presses upon said first actuator, and said fourth end of said second lever includes a second cam arranged so that, when said second lever is in its fourth position, said second cam presses upon said second actuator.

* * * * *